US008322430B2

(12) United States Patent
Esparza et al.

(10) Patent No.: US 8,322,430 B2
(45) Date of Patent: Dec. 4, 2012

(54) PIPES, SYSTEMS, AND METHODS FOR TRANSPORTING FLUIDS

(75) Inventors: Jose Oscar Esparza, Katy, TX (US); George John Zabaras, Houston, TX (US)

(73) Assignee: Shell Oil Company, Houston, TX (US)

( * ) Notice: Subject to any disclaimer, the term of this patent is extended or adjusted under 35 U.S.C. 154(b) by 628 days.

(21) Appl. No.: 11/420,841

(22) Filed: May 30, 2006

(65) Prior Publication Data

US 2010/0236633 A1 Sep. 23, 2010

Related U.S. Application Data

(60) Provisional application No. 60/687,359, filed on Jun. 3, 2005.

(51) Int. Cl.
*E21B 43/01* (2006.01)

(52) U.S. Cl. ..... 166/344; 166/357; 166/372; 166/105.5; 137/13; 137/602

(58) Field of Classification Search ..... 166/105.5, 166/357, 366, 91.1, 344, 345, 268, 372; 137/13, 137/896, 602
See application file for complete search history.

(56) References Cited

U.S. PATENT DOCUMENTS 3,225,787 A * 12/1965 Gogarty et al. ..... 137/561 R
3,414,004 A * 12/1968 Bankston ..... 137/237
3,502,103 A * 3/1970 Verschuur ..... 137/565.33
3,822,721 A * 7/1974 Verschuur ..... 137/896
3,826,279 A * 7/1974 Verschuur ..... 137/896
3,886,972 A 6/1975 Scott et al. ..... 137/602
3,892,252 A * 7/1975 Poettmann ..... 137/13
3,977,469 A 8/1976 Broussard et al. ..... 166/266
3,980,138 A * 9/1976 Knopik ..... 166/370
4,047,539 A 9/1977 Kruka ..... 137/13
4,462,429 A * 7/1984 Coursen ..... 137/891
4,510,958 A * 4/1985 Coursen ..... 137/13
4,603,735 A * 8/1986 Black ..... 166/68
4,745,937 A 5/1988 Zagustin et al. ..... 137/13
4,753,261 A 6/1988 Zagustin et al. ..... 137/13
4,861,352 A * 8/1989 Cheng ..... 75/708
4,988,389 A * 1/1991 Adamache et al. ..... 166/302
5,104,516 A * 4/1992 de Bruijn et al. ..... 208/107
5,105,843 A * 4/1992 Condron et al. ..... 137/13
5,159,977 A 11/1992 Zabaras ..... 166/105
5,199,496 A * 4/1993 Redus et al. ..... 166/366
5,385,175 A 1/1995 Rivero et al. ..... 138/145
6,076,599 A * 6/2000 McKinzie ..... 166/105
6,105,671 A 8/2000 McKinzie et al. ..... 166/265
6,364,013 B1 * 4/2002 Watson et al. ..... 166/105
6,390,114 B1 * 5/2002 Haandrikman et al. ..... 137/2
6,983,802 B2 * 1/2006 Bolin et al. ..... 166/369
7,073,597 B2 * 7/2006 Williams ..... 166/372
2007/0157985 A1 * 7/2007 Caro et al. ..... 138/40

OTHER PUBLICATIONS

PCT/US06/21199. International Search Report. dated Dec. 11, 2007.

* cited by examiner

*Primary Examiner* — Matthew Buck

(57) ABSTRACT

There is disclosed a system adapted to transport two fluids and a gas comprising a nozzle comprising a first nozzle portion comprising the first fluid and the gas, and a second nozzle portion comprising the second fluid, wherein the second nozzle portion has a larger diameter than and is about the first nozzle portion; and a tubular fluidly connected to and downstream of the nozzle, the tubular comprising the first fluid and the gas in a core, and the second fluid about the core.

11 Claims, 17 Drawing Sheets

PIPES, SYSTEMS, AND METHODS FOR TRANSPORTING FLUIDS

CROSS-REFERENCE TO RELATED APPLICATION

The present application claims the benefit of the filing date of U.S. Provisional patent application Ser. No. 60/687,359, filed on Jun. 3, 2005, the disclosure of which is incorporated herein by reference.

BACKGROUND OF INVENTION

1. Field of the Invention

The field of the invention relates to core flow of fluids through a tubular.

2. Background Art

Core-flow represents the pumping through a pipeline of a viscous liquid such as oil or an oil emulsion, in a core surrounded by a lighter viscosity liquid, such as water, at a lower pressure drop than the higher viscosity liquid by itself. Core-flow may be established by injecting the lighter viscosity liquid around the viscous liquid being pumped in a pipeline. Any light viscosity liquid vehicle such as water, petroleum and its distillates may be employed for the annulus, for example fluids insoluble in the core fluid with good wettability on the pipe may be used. Any high viscosity liquid such as petroleum and its by-products, such as extra heavy crude oils, bitumen or tar sands, and mixtures thereof including solid components such as wax and foreign solids such as coal or concentrates, etc. may be used for the core.

Friction losses may be encountered during the transporting of viscous fluids through a pipeline. These losses may be due to the shear stresses between the pipe wall and the fluid being transported. When these friction losses are great, significant pressure drops may occur along the pipeline. In extreme situations, the viscous fluid being transported can stick to the pipe walls, particularly at sites that may be sharp changes in the flow direction.

To reduce friction losses within the pipeline, a less viscous immiscible fluid such as water may be injected into the flow to act as a lubricating layer for absorbing the shear stress existing between the walls of the pipe and the fluid. This procedure is known as core flow because of the formation of a stable core of the more viscous fluid, i.e. the viscous oil, and a surrounding, generally annular, layer of less viscous fluid.

Core flow may be established by injecting the less viscous fluid around the more viscous fluid being pumped in the pipeline.

Although fresh water may be the most common fluid used as the less viscous component of the core flow, other fluids or a combination of water with additives may be used.

The world's easily found and easily produced petroleum energy reserves are becoming exhausted. Consequently, to continue to meet the world's growing energy needs, ways must be found to locate and produce much less accessible and less desirable petroleum sources. Wells may be now routinely drilled to depths which, only a few decades ago, were unimagined. Ways are being found to utilize and economically produce reserves previously thought to be unproducible (e.g., extremely high temperature, high pressure, corrosive, sour, and so forth). Secondary and tertiary recovery methods are being developed to recover residual oil from older wells once thought to be depleted after primary recovery methods had been exhausted.

Some reservoir fluids have a low viscosity and may be relatively easy to pump from the underground reservoir. Others have a very high viscosity even at reservoir conditions.

Electrical submersible pumps may be used with certain reservoir fluids, but such pumps generally lose efficiency as the viscosity of the reservoir fluid increases.

If the produced crude oil in a well has a high viscosity for example, viscosity from about 200 to about 2,000,000 (centiPoise) cP, then friction losses in pumping such viscous crudes through tubing or pipe can become very significant. Such friction losses (of pumping energy) may be due to the shearing stresses between the pipe or tubing wall and the fluid being transported. This can cause significant pressure gradients along the pipe or tubing. In viscous crude production such pressure gradients cause large energy losses in pumping systems, both within the well and in surface pipelines.

Reservoir fluids may also be accompanied by reservoir gases which may be generally separated prior to pumping the reservoir fluids. This causes the need to reinject the gases into the reservoir, provide a separate transportation conduit for the gases, or otherwise dispose of the gases.

U.S. Pat. No. 5,159,977, discloses that the performance of an electrical submersible pump may be improved by injection of water such that the water and the oil being pumped flow in a core flow regime, reducing friction and maintaining a thin water film on the internal surfaces of the pump. U.S. Pat. No. 5,159,977 is herein incorporated by reference in its entirety.

There is a need in the art to provide economical, simple techniques for moving viscous fluids and gases in a tubular.

SUMMARY OF INVENTION

One aspect of the invention provides a system adapted to transport a two fluids and a gas comprising a nozzle comprising a first nozzle portion comprising the first fluid and the gas, and a second nozzle portion comprising the second fluid, wherein the second nozzle portion has a larger diameter than and is about the first nozzle portion; and a tubular fluidly connected to and downstream of the nozzle, the tubular comprising the first fluid and the gas in a core, and the second fluid about the core.

Another aspect of invention provides a method for transporting a first fluid, a second fluid, and a gas, comprising injecting the first fluid and the gas through a first nozzle portion into a core portion of a tubular; injecting the second fluid through a second nozzle portion into the tubular, the second fluid injected about the core portion of the first fluid and the gas.

DETAILED DESCRIPTION

In one embodiment, there is disclosed a system adapted to transport two fluids and a gas comprising a nozzle comprising a first nozzle portion comprising the first fluid and the gas, and a second nozzle portion comprising the second fluid, wherein the second nozzle portion has a larger diameter than and is about the first nozzle portion; and a tubular fluidly connected to and downstream of the nozzle, the tubular comprising the first fluid and the gas in a core, and the second fluid about the core. In some embodiments, the first fluid comprises a higher viscosity than the second fluid. In some embodiments, the system also includes a pump upstream of the nozzle, wherein the pump has a first outlet to the large diameter nozzle portion and a second outlet to the small diameter nozzle portion. In some embodiments, the system also includes a pump downstream of the nozzle, wherein the pump is adapted to receive a core flow from the nozzle into a pump inlet. In some embodiments, the first fluid comprises a viscosity from 30 to 2,000,000, for example from 100 to 100,000, or from 300 to 10,000 centipoise, at the temperature the first fluid flows out of the nozzle. In some embodiments, the second fluid comprises a viscosity from 0.001 to 50, for example from 0.01 to 10, or from 0.1 to 5 centipoise, at the temperature the second fluid flows out of the nozzle. In some embodiments, the second fluid comprises a silicate and/or an emulsion breaker, such as 100-300 ppm of sodium metasilicate and/or 20-50 ppm of hydroxyl-ethyl-cellulose and/or an asphaltic crude emulsifier. In some embodiments, the second fluid comprises from 5% to 40% by volume, and the first fluid and the gas comprises from 60% to 95% by volume of the total volume of the second fluid, the first fluid, and the gas as the second fluid, the first fluid, and the gas leave the nozzle. In some embodiments, the gas comprises from 5% to 30% of the total volume of the first fluid and the gas as the first fluid and the gas leave the nozzle. In some embodiments, the gas comprises one or more of methane, ethane, propane, butane, carbon dioxide, and mixtures thereof. In some embodiments, the tubular has at least one vertical portion.

In one embodiment, there is disclosed a method for transporting a first fluid, a second fluid, and a gas, comprising injecting the first fluid and the gas through a first nozzle portion into a core portion of a tubular; injecting the second fluid through a second nozzle portion into the tubular, the second fluid injected about the core portion of the first fluid and the gas.

Figure 1:
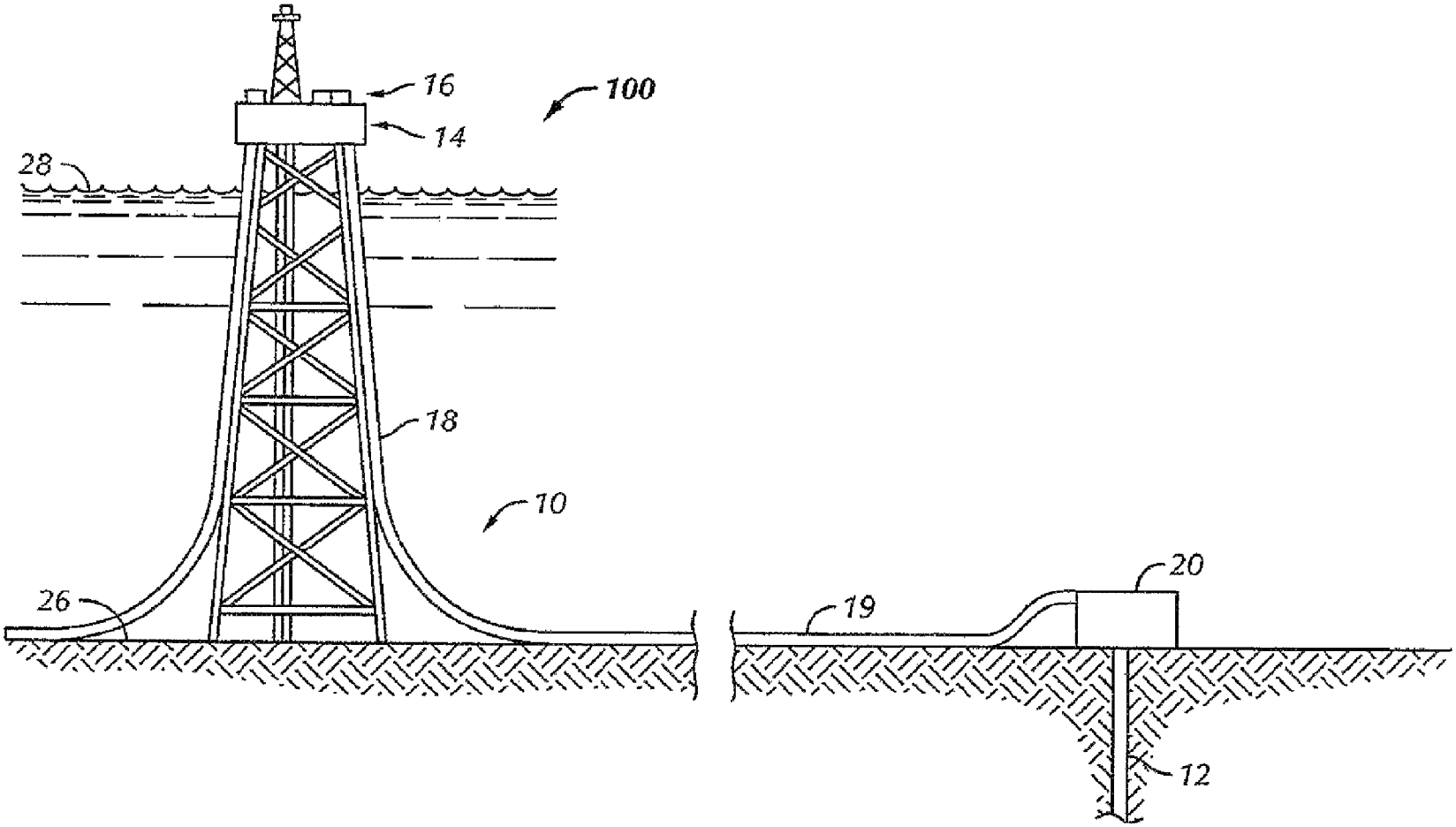
FIG. 1 illustrates an offshore system in accordance with the embodiments of the present disclosure.

Referring first to FIG. 1, there is illustrated offshore system 100, one suitable environment in which the invention may be used. System 100 may include platform 14 with facilities 16 on top. Platform may be in a body of water having water surface 28 and bottom of the body of water 26. Tubular 10 may connect platform 14 with wellhead and/or blow out preventer 20 and well 12. Tubular 10 includes horizontal and off-horizontal inclined portions 19 and vertical portions 18.

Figure 2:
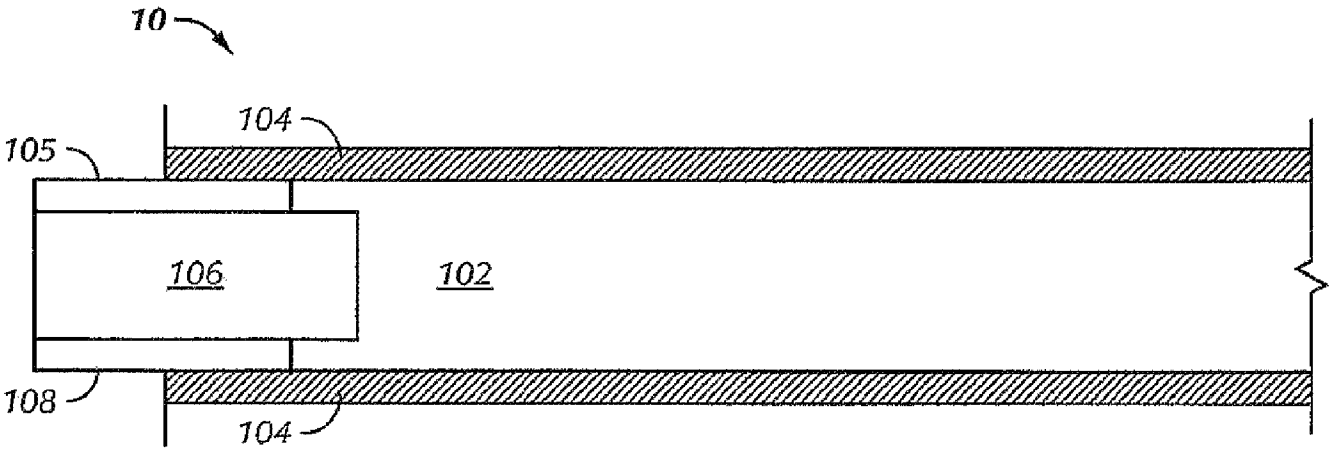
FIG. 2 shows a cross-sectional view of a tubular including a nozzle in accordance with an embodiment of the present disclosure.

Referring now to FIG. 2, in some embodiments of the invention, tubular 10 is illustrated. Tubular 10 includes tube element 104 enclosing passage 102. Nozzle 105 may be provided in passage 102, and includes large diameter nozzle portion 108, and small diameter nozzle portion 106.

In operation, nozzle 105 may be used to create a core flow within passage 102. A first fluid and a gas may be pumped through small diameter nozzle portion 106, and a second fluid may be pumped through large diameter nozzle portion 108.

Figure 3:
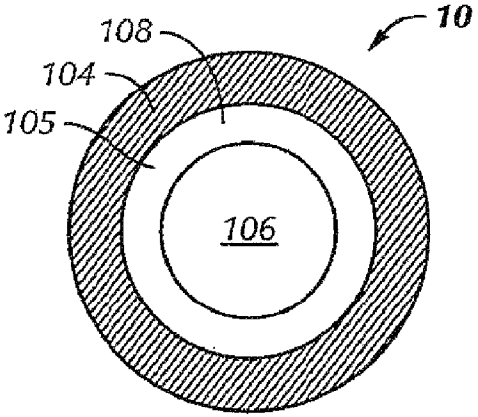
FIG. 3 shows a cross-sectional view of a tubular including a nozzle in accordance with an embodiment of the present disclosure.

Referring now to FIG. 3, in some embodiments of the invention, a cross sectional view of tubular 10 is illustrated. Tubular 10 includes tube element 104, with nozzle 105 inserted into passage 102. Nozzle 105 includes large diameter nozzle portion 108, and small diameter nozzle portion 106.

Figure 4:
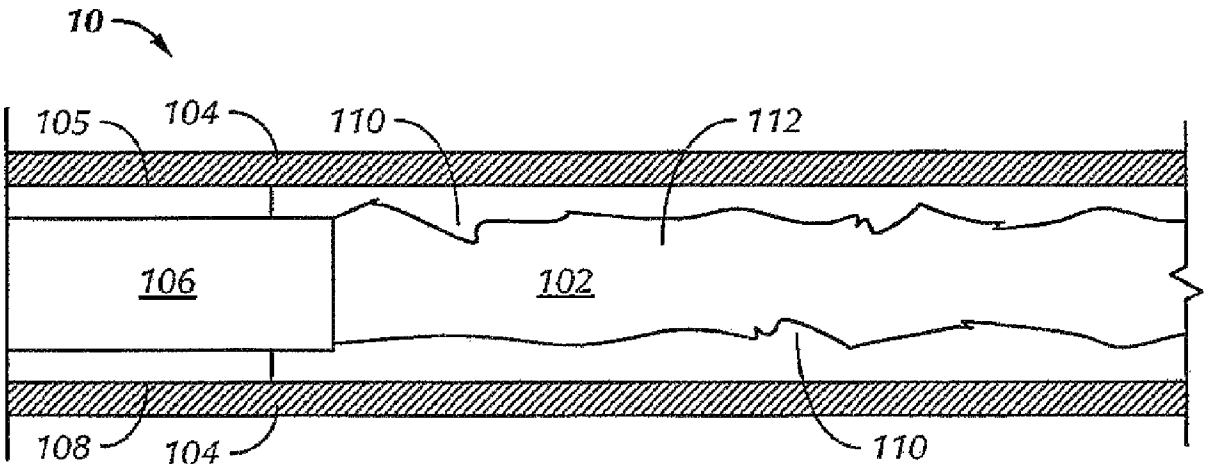
FIG. 4 shows a cross-sectional view of a tubular a nozzle having a core flow in accordance with an embodiment of the present disclosure.

Referring now to FIG. 4, in some embodiments of the invention, a side view of tubular 10 is illustrated. Tubular 10 includes tube element 104 enclosing passage 102. Nozzle 105 may be provided in passage 102, and includes large diameter nozzle portion 108 and small diameter nozzle portion 106. A first fluid 112 and a gas may be pumped through small diameter nozzle portion 106, a second fluid 110 may be pumped through a large diameter nozzle portion 108.

In operation, the first fluid 112 and a gas travel as a core through passage 102 and may be completely surrounded by second fluid 110. Second fluid 110 may act as a lubricant, and/or eases the transportation of first fluid 112, so that the pressure drop for transporting first fluid 112 may be lower with a core flow than if the first fluid 112 were transported by itself.

Figure 5:
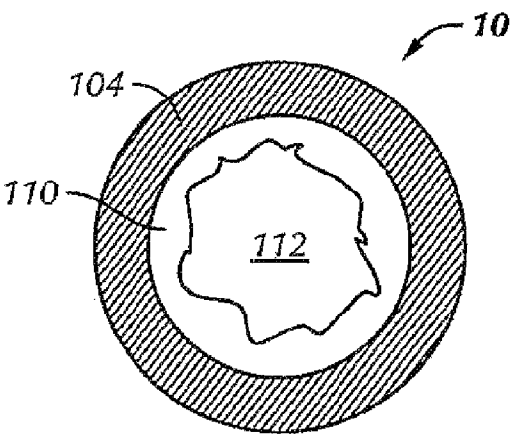
FIG. 5 shows a cross-sectional view of a tubular having a core flow in accordance with an embodiment of the present disclosure.

Referring now to FIG. 5, in some embodiments in the invention, a cross sectional view of tubular 10 is illustrated. Tubular 10 includes tube element 104 which may be transporting first fluid 112 and optionally a gas as a core, which may be completely surrounded by second fluid 110, in a coreflow regime.

Figure 6:
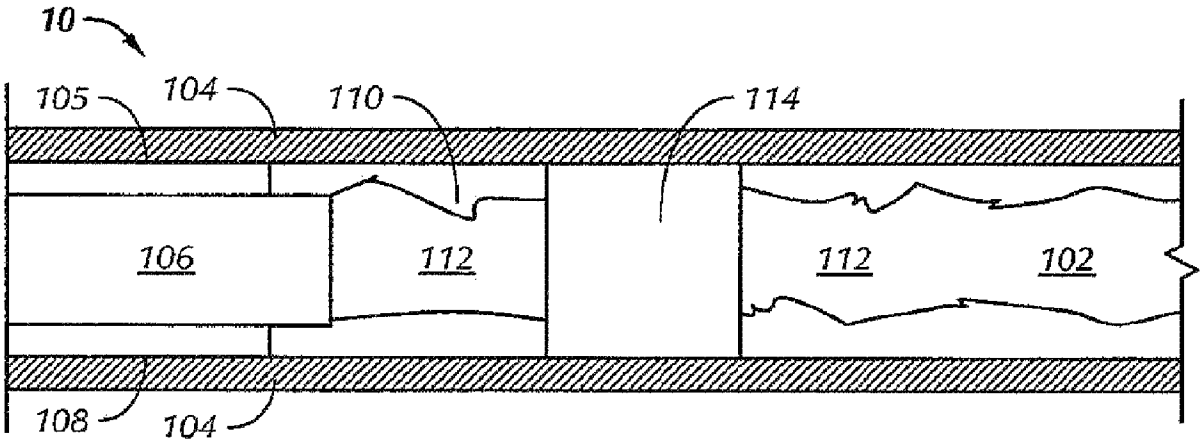
FIG. 6 shows a cross-sectional view of a tubular including a nozzle and a pump having a core flow in accordance with an embodiment of the present disclosure.

Referring now to FIG. 6, in some embodiments of the invention, tubular 10 is illustrated. Tubular 10 includes tube element 104 enclosing passage 102. Nozzle 105 may be provided in passage 102, and includes large diameter nozzle portion 108 and small diameter nozzle portion 106. Small diameter nozzle portion 106 may be feeding first fluid 112 and optionally a gas, and large diameter nozzle portion 108 may be feeding second fluid 110 completely around first fluid 112. This creates a core flow arrangement of first fluid 112 and the gas, surrounded by second fluid 110. Pump 114 may be provided downstream of nozzle 105 to pump first fluid 112 and the gas and second fluid 110 through tubular 10.

Figure 7:
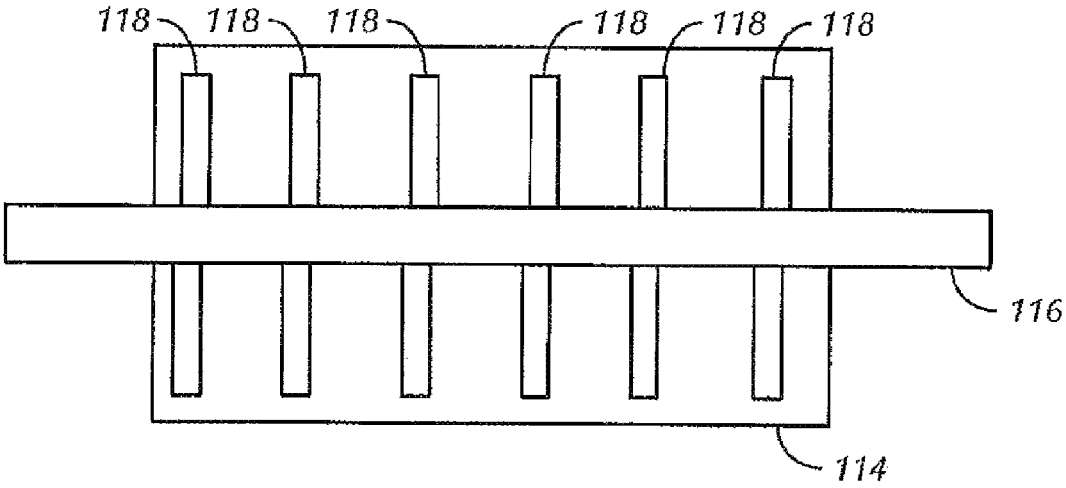
FIG. 7 shows a cross-sectional view of a pump in accordance with the embodiments of the present disclosure.

Referring now to FIG. 7, in some embodiments, pump 114 is illustrated. Pump 114 includes shaft 116, which may be adapted to rotate. A plurality of impeller stages 118 may be attached to shaft 116 so that impeller stages 118 rotate when shaft 116 rotates to force one or more fluids and one or more gases through pump 114.

Figure 8:
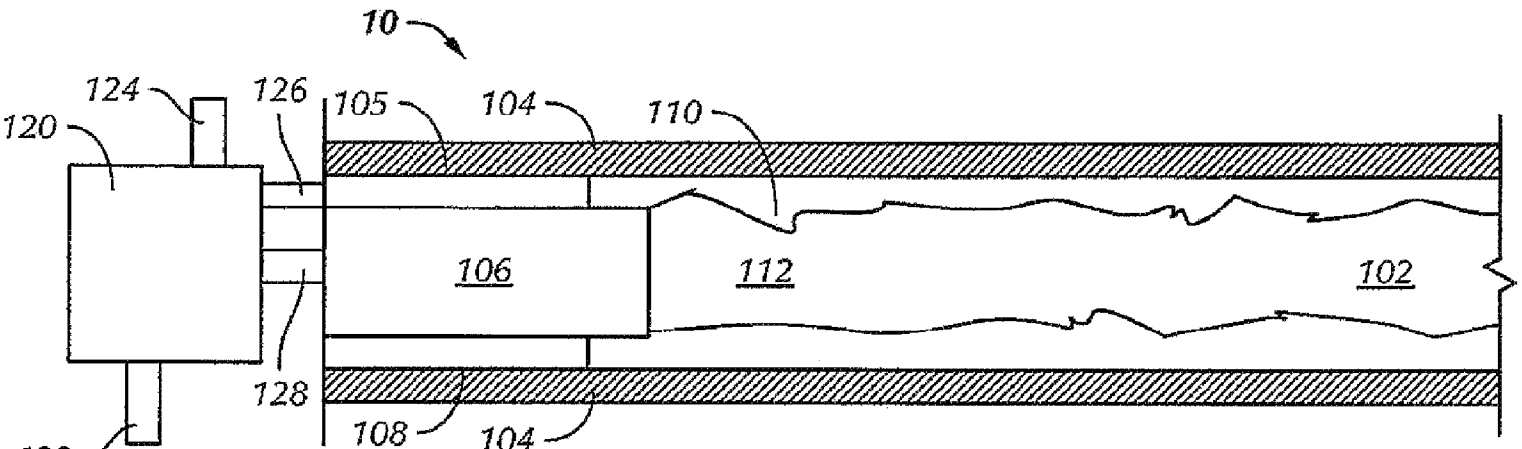
FIG. 8 shows a cross-sectional view of a tubular having a core flow including a nozzle and a pump in accordance with an embodiment of the present disclosure.

Referring now to FIG. 8, in some embodiments of the invention, tubular 10 is illustrated. Tubular 10 includes tube element 104 enclosing passage 102. Nozzle 105 may be provided in passage 102, and includes large diameter nozzle portion 108 and small diameter nozzle portion 106. Small diameter nozzle portion 106 may be feeding first fluid 112 and a gas, and large diameter nozzle portion 108 may be feeding second fluid 110 around first fluid 112. This creates a core flow arrangement of first fluid 112 and the gas, surrounded by second fluid 110. Pump 120 may be provided upstream of nozzle 105 to pump first fluid 112 and the gas from inlet 124 to outlet 128 and into small diameter nozzle portion 106, and to pump second fluid 110 from inlet 122 to outlet 126 and into large diameter nozzle portion 108.

In some embodiments, water may be provided from the surface, optionally with one or more chemical additives, through a conduit to inlet 122 of pump 120. In some embodiments, oil and gas from a formation may be collected in a tubular and provided to inlet 124 of pump 120.

In some embodiments, core flow inducing nozzle 105 may be used to create core flow in horizontal flow line 19 and/or vertical flow line 18 for viscous or waxy fluids. In some embodiments, core flow inducing nozzle 105 creates core flow in flow lines by injecting second fluid, such as water or gasoline, around a central core.

In some embodiments, viscous water in oil emulsions may be produced during recovery of viscous oils and may be a ready source of water for purposes of core flow. Such emulsions may be "broken" for example by injecting chemicals into the emulsion. Suitable emulsion breakers include hydroxyl-ethyl-cellulose (HEC) and an asphaltic crude emulsifier sold under the tradename "PAW4" by Baker-Petrolite of Sugar Land, Tex., USA. Such chemicals may be injected in pump 120, upstream of nozzle 105, in nozzle 105, between nozzle 105 and pump 114, and/or downstream of pump 114.

In some embodiments, second fluid 110 may include a silicate, such as from about 100 to about 300 ppm of sodium metasilicate, and/or an emulsion breaker, such as from about 20 to about 50 ppm of hydroxyl-ethyl-cellulose (HEC) and/or from about 300 to about 500 ppm of an asphaltic crude emulsifier.

In some embodiments, second fluid 110 may comprise from about 5% to about 70% of the total volume of second fluid 110, gas and first fluid 112, for example measured at the temperature and pressure as the total volume is leaving nozzle 105. In some embodiments, second fluid 110 may comprise from about 10% to about 50% of the total volume of second fluid 110, gas and first fluid 112. In some embodiments, second fluid 110 may comprise from about 20% to about 40% of the total volume of second fluid 110, gas and first fluid 112. In some embodiments, second fluid 110 may be made up of added fluid to the mixture and/or breaking an emulsion to release additional second fluid 110.

After the mixture is passed through the core-flow creating nozzle 105, tubular 10 may be increased in size by means of a conical diffusor, decreased in size by an inverted diffusor or continued in the same size. The choice may depend upon the desired flow rate. A fast rate may destroy core-flow inasmuch as the swirls and eddy currents in second fluid 110 and first fluid 112 may cause intermixing of the two whereby second fluid 110 and first fluid 112 may be emulsified and core-flow could be lost. Alternatively, a very slow rate may destroy core-flow inasmuch as at such rates gravitational effects overcome the weak secondary flows suspending first fluid 112 within second fluid 110 annulus, and may allow first fluid 112 to touch tubular 10 leading to the loss of core-flow. Thus, a flow rate may be used which tends to maintain core-flow throughout the length of tubular 10.

In some embodiments, nozzle 105 may have a variable area ratio mixing section whereby adjustments can be made to avoid situations where the first fluid 112 velocity may be greater than the second fluid 110 velocity at the point of contact, so that first fluid 112 core may have a tendency to spiral into the tubular 10, or where the first fluid 112 velocity may be lower than that of the second fluid 110, so that the core may tend to break up into segments. In some embodiments, nozzle 105 allows a change in the water-to-oil ratio in order to first, change the flow rate of the mixture, second, better utilize the second fluid and/or third, increase or decrease the throughput. By use of this nozzle 105, the velocities of the two fluids can be matched.

In some embodiments, first fluid 112 may range in viscosity from about 10 to about 2,000,000 Centipoise, or from about 100 to about 500,000 Centipoise, for example measured at the temperature and pressure as first fluid 112 leaves nozzle 105.

In some embodiments, in order to start core flow, passage 102 may be filled with second fluid 110, and then core-flow of first fluid 112 may be established. The core flow may be established using any suitable technique known in the art. In some embodiments, first fluid 112 may be injected into a central portion of passage 102 through nozzle 105 by operation of a pump 120. Simultaneously, second fluid 110, such as water, may be injected into outer portions of passage 102 through nozzle 105 by pump 120 at a fraction and a flow rate sufficient to obtain the critical velocity needed to form an annular flow of second fluid 110 about first fluid 112. In some embodiments, second fluid 110 volume fraction may be from about 5% to about 35%, or from about 10% to about 25%, for example about 15%, of the total volume of second fluid 110, gas, and first fluid 112 as the total volume leaves nozzle 105.

In some embodiments, pump 114 and/or pump 120 may include one or more separators at the pump inlet. These inlet separators may utilize centripetal acceleration to remove and expel some vapors, while allowing some vapors to pass into pump 114 and/or pump 120 with first fluid 112. Inlet separators are well known and commercially available.

In some embodiments, first fluid 112 may include from about 1% to about 25% by volume of a gas, for example from about 5% to about 20%, or from about 10% to about 15%, at the temperature and pressure as first fluid 112 and gas leave nozzle 105. Gases which may be in first fluid 112 include natural gas, nitrogen, air, carbon dioxide, methane, ethane, propane, butane, other hydrocarbons, and mixtures thereof. For purposes of this disclosure all materials in the gaseous phase including gases and vapors are being referred to as "gas."

Second fluid 110 may be a liquid hydrocarbon, salt water, brine, seawater, fresh water, or tap water. Solid particles which can plug the second fluid 110 flow areas or settle out during shutdown periods may be removed from second fluid 110 prior to injection into passage 102.

In some embodiments, first fluid 112 and gas and second fluid 110, for example oil and natural gas, and water, produced from a production zone may be allowed to separate by gravity in a segregated portion of the casing/production tubing annulus in a well borehole. A first pump inlet located in the production zone picks up primarily second fluid 110 which may be then injected into the passage 102 in a geometrical manner to form a circumferential sheath around the interior circumference of passage 102 going to the surface. A second pump inlet located in a different part of the production zone picks up primarily first fluid 112 and the pump system injects it into the center of passage 102. This creates a core annular flow regime in tubular 10. Once the core annular flow is established, the resistance to fluid flow in the production tubing may be reduced to a fraction of that of a continuous first fluid 112 phase. The remainder of the produced second fluid 110 not used for the core annular flow regime may then be disposed of the same as previously mentioned, such as by re-injection in a disposal zone. In some embodiments, this technique may be used with first fluids 112 having a viscosity of greater than about 10 cP, for example greater than about 100 cP, or greater than about 1000 cP, up to 150,000 cP.

The promotion of core annular flow may result in one or more of the following: 1) reducing the effective viscosity of first fluid 112 and gas; 2) reducing drag along the tubing wall; 3) transporting first fluid 112 and one or more gases in a core flow arrangement; and/or 4) reducing pressure drop for first fluid 112 and gas transportation.

In some embodiments, pump 114 and/or pump 120 may be an electrical submersible pump, for example an electrical submersible centrifugal pump. Pump 114 and/or pump 120 may includes a series, or plurality, of impeller or centrifugal pump stages 118, each pump stage including one or more impellers. In some embodiments, pump 114 and/or pump 120 may be an electrical submersible progressive cavity pump, including one or more progressive cavity pump stages, each of which may include a rotor and a stator. In some embodiments, pump 114 and/or pump 120 may be an axial flow pump, including one or more axial flow stages, each of which may include an impeller and a stator, or a rotor and a stator.

Pump 114 and/or pump 120 may be driven by a mud motor or an electric motor which may be encased within a motor section adjacent an end of pump 114 and/or pump 120, for example below pump 114 and/or pump 120. The placement of the motor may depend on various factors, such as the size of the motor or the dimensions of a well into which the pump 114 and/or pump 120 may be placed.

A pump outlet may be disposed at an upper end of pump 114 and/or pump 120. Alternatively, pump 114 and/or pump 120 may have more than one pump outlet.

In some embodiments, as produced fluids (i.e., hydrocarbons and water) are withdrawn from a subterranean reservoir, the produced fluids may be drawn into pump 114 and/or pump 120 through a pump inlet. The produced fluids may be transported through pump 114 and/or pump 120 in a well-known manner. Once inside pump 114 and/or pump 120, the rotation of impellers 118 causes the produced fluids to be accelerated through the pump.

In some embodiments, inner walls of passage 102 may be coated with a substantially oleophobic and hydrophilic material. When oil is transported in the form of an oil/water system in tubular 10, the water tends to spread and coat or wet the inner surface, while oil has a high contact angle with the material of the inner surface and may be therefore easily displaced by the water so as to prevent undesirable adhesion. In some embodiments, the inner surface material of the tubular 10 comprises a substance or composition having a silica content, which has been found to provide the inner surface with the desired oleophobic and hydrophilic characteristics and contact angle with oil. In some embodiments, inner walls of passage 102 may be soaked with a 300 ppm sodium metasilicate solution.

In some embodiments, tubular 10 has a diameter of about 2.5 to 60 cm. In some embodiments, tubular 10 has a diameter of about 5 to 30 cm. In some embodiments, tubular 10 has a diameter of about 10 to 20 cm.

In some embodiments, nozzle portion 108 has an outside diameter of about 2.5 to 60 cm. In some embodiments, nozzle portion 108 has an outside diameter of about 5 to 30 cm. In some embodiments, nozzle portion 108 has an outside diameter of about 10 to 20 cm.

In some embodiments, nozzle portion 106 has an outside diameter of about 1 to 30 cm. In some embodiments, nozzle portion 106 has an outside diameter of about 3 to 15 cm. In some embodiments, nozzle portion 106 has an outside diameter of about 5 to 10 cm.

In some embodiments, tubular 10 has a wall thickness of about 0.1 to 5 cm. In some embodiments, tubular 10 has a wall thickness of about 0.25 to 2.5 cm. In some embodiments, tubular 10 has a wall thickness of about 0.5 to 1.25 cm.

In some embodiments, tubular 10 may be a carbon steel or an aluminum pipe.

Those of skill in the art will appreciate that many modifications and variations may be possible in terms of the disclosed embodiments, configurations, materials and methods without departing from their spirit and scope. Accordingly, the scope of the claims appended hereafter and their functional equivalents should not be limited by particular embodiments described and illustrated herein, as these are merely exemplary in nature.

EXAMPLES

Description of Heavy Oil Flow Loop

Figure 9:
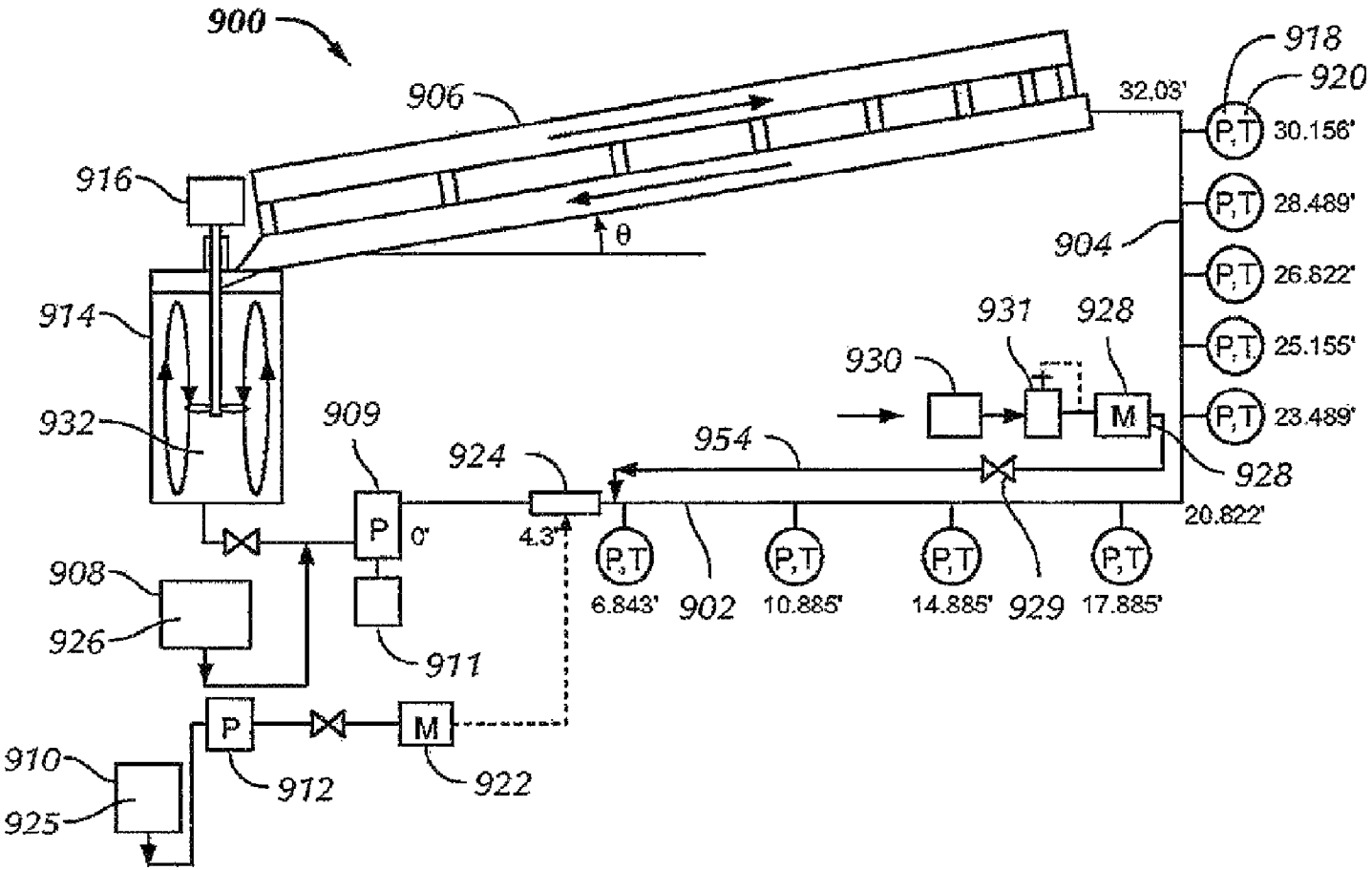
FIG. 9 shows a simple schematic of a flow loop in accordance with an embodiment of the present disclosure.

FIG. 9 shows a simplified schematic of a Heavy oil flow loop in accordance with an embodiment of the present disclosure. The flow loop 900 is 32-ft long and has a 1¼" diameter (1.38" inside diameter). The flow loop 900 was built to study the multiphase flow of heavy oil, water, and gas. In particular, the intention was to use dead oil from the BS4 field offshore Brazil to determine the feasibility of a) heavy oil/water coreflow with simultaneous flow of nitrogen and b) water-continuous emulsion flow with simultaneous nitrogen flow in both horizontal and vertical inclinations. It was also the intention to gather horizontal and vertical pipe pressure drop data with heavy oil and gas for the purpose of comparisons with multiphase flow model predictions. Most available multiphase flow models have been benchmarked with data from low to medium viscosity crudes. Their applicability to heavy oils is questionable and therefore the true benefit of gas-lift as an artificial lift method for heavy oils cannot be reliably assessed. It was considered as part of the scope of the present work to evaluate the limits of gas-lift with heavy oils based on experimental heavy oil-gas flow data from the new flow loop 900.

The flow loop design objectives were to design a flow system(s) suited to demonstration and testing of the following types of flow using BS4 heavy oil offshore Brazil:

- Once-through flow system with oil flowing as a core sliding on a water film with or without simultaneous nitrogen flow.
- Continuous circulation of oil mixed with water in a dispersion or emulsion using various chemical additives to control the emulsion characteristics with or without simultaneous nitrogen flow.

Oil mixed with a solvent (diesel or a light mineral oil, e.g.) to control its viscosity.

Parameters common to each of the above modes of testing include knowledge of oil temperature at the inlet, measurement of temperature and pressure at various positions along the tube, ability to add nitrogen, ability to heat the oil/water receiving tank, ability to separate gas-lift gas and vent and provision for cleaning oil off the internal flow surfaces. Additionally, for Core Flow . . . an isokinetic inlet nozzle to introduce water at 20% by volume in an annular sheath; once-through flow and batch-wise oil/water separation, followed by oil re-injection Dispersion or Emulsion Flow . . . stirring/mixing needed to blend emulsifiers; establish techniques to make and break the emulsion

Flow Loop Components

The flow loop 900 is comprised of 20.2 feet of a horizontal pipe section 902 and 11.8 feet of a vertical pipe section 904, also known as a riser, both pipe sections 902,904 having a 1¼" (1.38" ID) diameter. The top 0.625 ft of the riser 904 is a 3" ID transition pipe spool (not shown) connecting the riser 904 with an inclined-plane gas-liquid separator 906. Oil 926 is stored in a 60 gallon elevated aluminium tank 908 (22.5" diameter by 35" height) and is pumped with a positive displacement screw-type pump 909 (e.g., Viking model AS4193) driven by a motor 911 (e.g., 10 HP Siemens 284T motor) connected to a variable speed drive (e.g., model GV3000/SE by Reliance Electric). The pump 909 and motor 911 RPM has been calibrated to provide a measurement of the oil flow rate. The oil pump 909 includes an internal pressure relief valve (not shown) set at 230 psig, which therefore defines the maximum possible operating pressure for the flow loop 900. Water 925 is similarly stored in a 60 gal aluminium tank 910 and pumped into the flow loop 900 via a 1 HP driven centrifugal pump 912 or other pumps known in the art. The receiving tank 914 has an approximately 91 gallon capacity and includes a steam heated jacket (not shown) and an external insulation (not shown). In addition, a low RPM electric stirrer 916 is also installed in this tank 914. Nine sets of pressure transducers 918 and thermocouples 920 have been installed along the flow path, four sets 918, 920 on the horizontal pipe section 902 and five sets 918, 920 on the vertical pipe section 904. The pressure transducers 918 are differential Validyne variable reluctance type with one end open to the atmosphere. Special pressure taps (not shown) were designed and installed to assure that water 925 rather than oil 926 will be in contact with the transducer diaphragm.

A nitrogen gas supply 930 was used in conjunction with a valve 929 and a pressure regulator 931 to provide the flow loop 900 with gas 954 flow rates of up to 10 scf/min at ~200 psig maximum pressure. House steam (not shown) was available and was used to supply heat to the oil 926 or oil/water mixture 932 in the receiving tank 914 for the purpose of either reducing the viscosity of the oil 926 or for assisting with the oil 926 dehydration.

Oil 926 flow rates were typically in the range from 2.2 to 16 gpm corresponding to superficial velocities of 0.5 to 3.4 ft/s. Water 925 was introduced into the flow loop 900 at rates from 0 to 4 gpm and was metered via a meter 922, for example a Halliburton turbine meter. During coreflow tests, the water 925 was injected through a specially made isokinetic inlet device 924.

Figure 10:
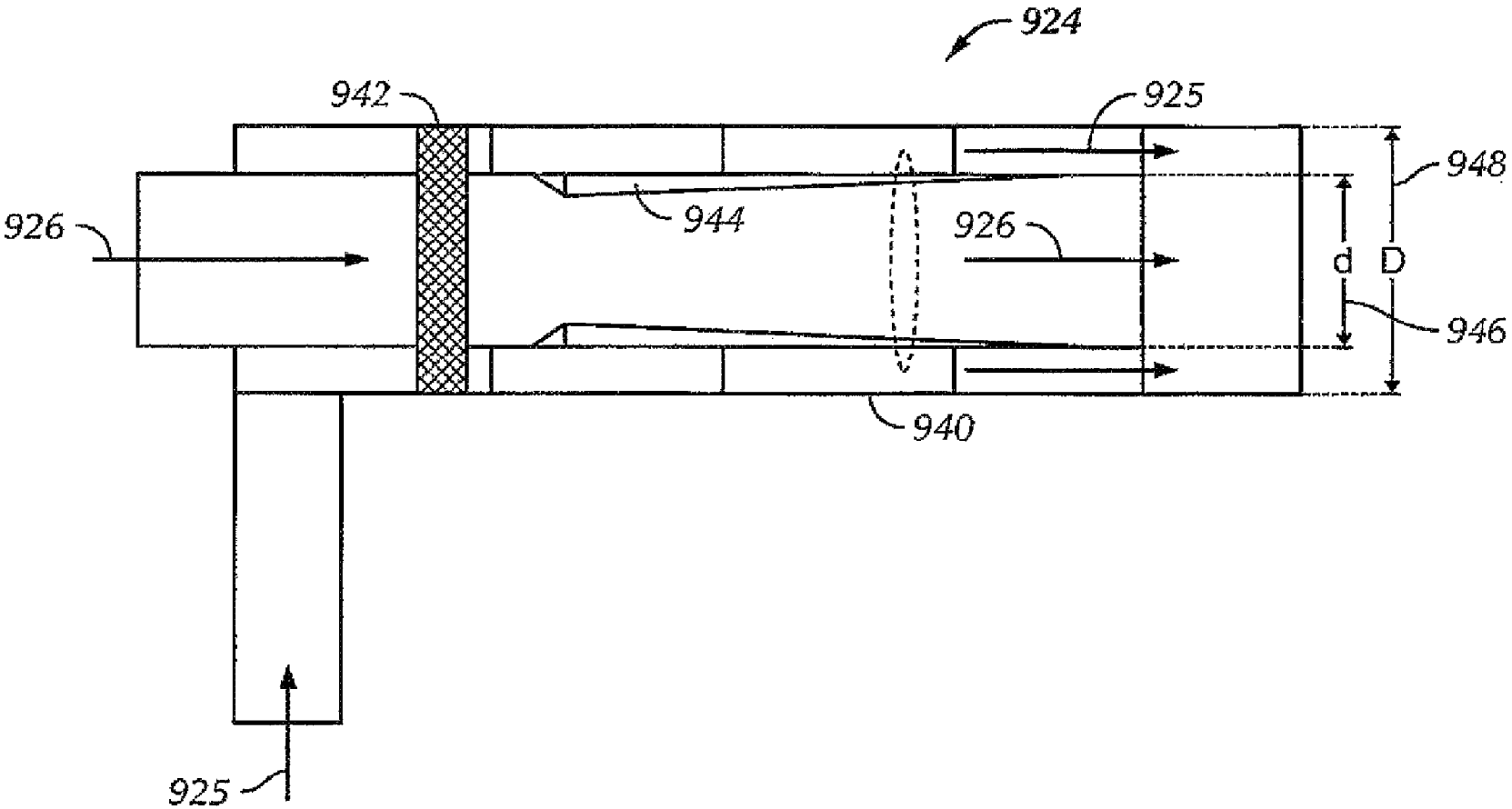
FIG. 10 shows a cross-sectional component view of a nozzle in accordance with an embodiment of the present disclosure.

FIG. 10 shows a component view of the isokinetic inlet device 924 in accordance with the embodiments disclosed in the present application. As shown in FIG. 10, this device 924 assures that the water 925 entering the flow loop 900 forms an annular film while the oil 926 flows as a core sliding on the lubricating water 925 film. The inlet device 924 includes a water distribution annulus baffle 942, and a nozzle 940. The nozzle includes an inner surface 944 tapered at an angle (i.e., 5 degrees) configured to prevent flow separation and to minimize shear at the oil-water interface. Flow rates within the nozzle may be kept in the range of 0.15 to 0.2 volume fraction water Equations 1 and 2 below may be used to derive dimensions of a first diameter 946 and a second diameter 948 of the nozzle 940.

$$V_{Oil} = V_{Water} \qquad \text{Equation 1}$$

$$\frac{Q_{water}}{Q_{Water} + Q_{Oil}} = 0.15 \text{ to } 0.2500 \qquad \text{Equation 2}$$

$$\frac{Q_{Water}}{Q_{Oil}} = \frac{0.15}{0.85} \text{ to } \frac{0.2}{0.8} = 0.1765 \text{ to } 0.2500$$

$$\frac{Q_{Oil}}{\frac{\pi}{4}d^2} = \frac{Q_{Water}}{\frac{\pi}{4}(D^2 - d^2)}$$

$$0.8944 < \frac{d}{D} < 0.9220$$

Figure 11:
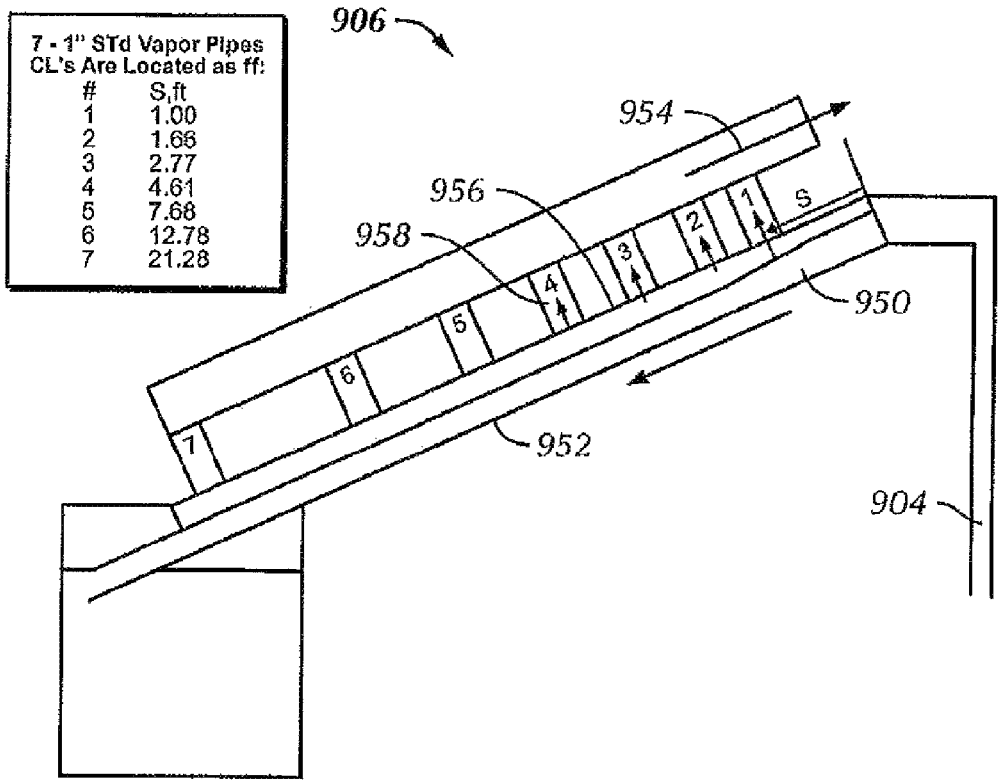
FIG. 11 shows a simple schematic of a portion of a flow loop in accordance with an embodiment of the present disclosure.

In order to facilitate degassing of the heavy oil during the tests with the simultaneous nitrogen flow, a falling film gas-liquid separator 906 was designed and built, as shown in FIG. 11. As shown, high viscosity fluid 950 (e.g., oil or oil/water mixture) at the top of the riser 904 spreads over the inclined plane 952 while the bulk of the gas 954 exits to the atmosphere. As viscous fluid 950 slides down the inclined plane 952, gas bubbles from inside the fluid rise to the film free surface 956 and vent through a plurality of vapor pipes 958 to the atmosphere as well. As shown in FIG. 11, the vapor pipes 958 may be positioned in various locations along the inclined plane 952. The under side of the inclined plane 952 could be steam-heated to further facilitate the degassing of the viscous oil 950 or emulsion. In one embodiment, the gas-liquid separator 906 may be rectangular in shape and sized to remove gas lift nitrogen from 5,000 cp oil.

Experimental Procedures

The test procedures differ depending on the type of flow testing i.e. oil and gas, oil-water coreflow with gas and emulsion flow with gas. These procedures may be carried out using a flow loop similar that shown in FIG. 9.

Oil and Gas Flow Testing

1. Load ~50 gallons of BS4 dead oil into the oil-water receiving tank (914).
2. Set the oil (926) flow rate by adjusting the oil pump motor RPM (909) to the appropriate value from the established oil rate versus RPM calibration curve. Manually open and close the necessary valves to allow continuous flow of the oil (926) from the oil tank (908) through the flow loop (900), down the inclined plane separator (906) and back into the receiving tank (914).
3. Introduce nitrogen (954) into the flow loop (900) by manipulating a gate valve (929) so that the desired rate has been set on the rotameter (928).
4. Start the data logger, recording nine pressures from transducers (918) (Validyne variable reluctance diaphragm) and nine temperatures from thermocouples (920) (type K thermocouple).

5. After the desired flow test time has elapsed, another flow condition can be studied by repeating steps 2 and/or 3.
6. When done with the testing, first stop the data logger, then shut-off the nitrogen rate and then the liquid rate.

Oil-Water Coreflow Testing

1. Prepare 50 gallons of brine with the BS4 produced water composition for sodium, potassium, magnesium and calcium chlorides and load it in the water tank (910).
2. Set the oil (926) flow rate in a bypass by adjusting the oil pump and motor (909, 911) RPM to the appropriate value from the established oil rate versus RPM calibration curve.
3. Start the data logger.
4. Introduce water (925) at a rate approximately equal to 25% of the oil (926) rate (20% watercut).
5. Switch the flow of oil (926) from the bypass to the flow loop (900).
6. For coreflow with gas, introduce nitrogen (954) into the flow loop (900) by manipulating a gate valve (929) so that the desired nitrogen (954) rate has been set on the rotameter (928).
7. After the desired flow test time has elapsed, another flow condition with a different gas rate but with same oil and water rates can be studied by changing the gas rate to another value.
8. The testing time is determined by the total available oil (926) volume of ~55 gallons and the pumped oil rate.
9. When done with the testing, first stop the data logger, then shut-off the nitrogen (954), then the liquid rate and lastly the water (925) rate.
10. Heat up the oil-water mixture (932) in the receiving tank (914) at a temperature over 150 F to expedite dehydration.
11. Upon completion of the dehydration process, transfer water (925) back to the water tank (910) and oil (926) to the oil tank (908). Repeat steps 2-10 for another series of coreflow tests.

Oil-Water Emulsion Testing

1. Prepare an emulsion by placing the desired volumes of BS4 oil and brine into the receiving tank (914). Set the tank's stirrer (916) on and circulate the oil/water mixture (932) through the flow loop (900) at a relatively high rate (typically above 15 gpm). Passing the fluid mixture (932) through the gear pump (909) and the flow loop (900) multiple times finally results in a homogeneous water in oil emulsion as confirmed by visual observation of the fluid mixture (932) sliding down from the inclined-plane separator (906) to the receiving tank (914). Mix in the emulsion the appropriate amount of emulsifier chemical for achieving a reverse emulsion during flow.
2. Set the emulsion flow rate in a bypass by adjusting the oil pump motor (909, 911) RPM to the appropriate value from the established oil rate versus RPM calibration curve.
3. Introduce nitrogen (954) into the flow loop (900) by manipulating a gate valve (929) so that the desired rate has been set on the rotameter (928).
4. Start the data logger.
5. After the desired flow test time has elapsed, another flow condition can be studied by repeating steps 2 and/or 3.
6. When done with the testing, first stop the data logger, then shut-off the nitrogen rate and then the liquid rate.

Test Fluids

Approximately 120 gallons of dead BS4 crude oil has been used in the present work and this oil originated in produced fluid from previous BS4 appraisal well flow tests. The deal oil specific gravity at 60 F is 0.97580 and the API gravity is 13.51.

Multiphase Flow of Heavy-Oil and Gas

Accurate prediction of multiphase flow in wellbores, flowlines and risers is of paramount importance for designing and operating deepwater production systems. Flow assurance strategies heavily depend on our ability to predict reliably the multiphase flow characteristics throughout the flow path from the reservoir to the receiving host facility. Accurate multiphase predictions are perhaps even more important with heavy oils. Existing in-house and commercially available software for multiphase flow of oil, water and gas rely on flow models that have been developed for mostly light oils and condensates. For example, basic modeling of the slug flow regime in the literature is based on the premise of turbulent flow in both the slug body and in the falling film around the Taylor bubble. However, for oils with viscosities of the order of magnitude of the BS4 oil, the flow in the liquid phase is almost always laminar. Therefore, significant discrepancy is expected between predicted pressure drops and heavy oil-gas flow data. The magnitude of the expected discrepancies is further aggravated by possible flow regime misidentification by existing flow pattern maps.

Figure 12:
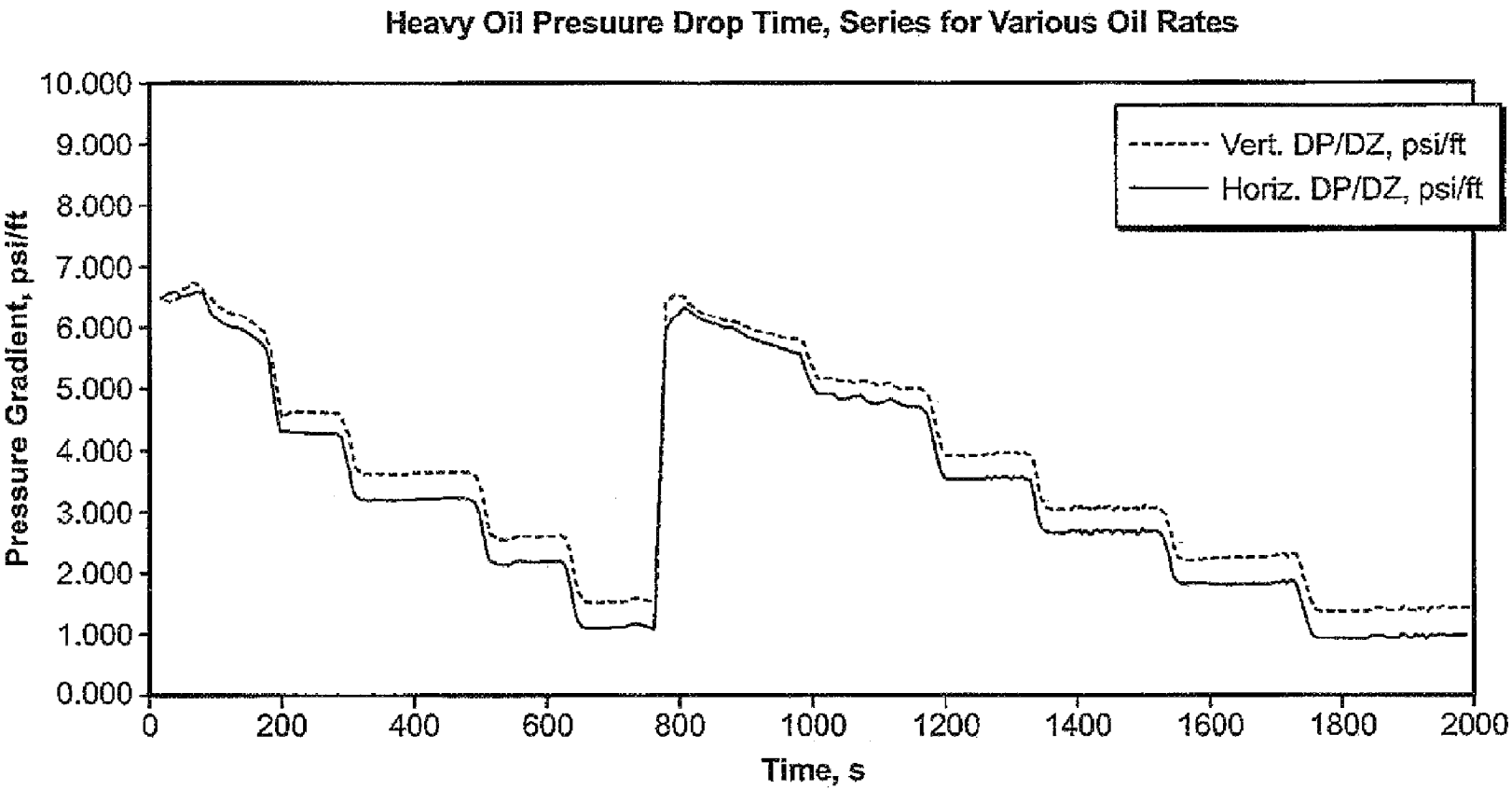
FIG. 12 shows a graph displaying heavy oil pressure drop time series for various oil rates in accordance with an embodiment of the present disclosure.

In order to assess the predictive capability of the existing models for gas-liquid flow with heavy oils, several series of tests were carried out to collect pressure drop data in both the horizontal and the vertical inclinations. This data may be found in Table 1 on the next page and is graphically displayed in FIG. 12. All flow conditions are in laminar flow as indicated by the calculated Reynolds numbers. The comparison of the predictions to the measured data is satisfactory and the predictions can be improved further using the measured temperature profile along the uninsulated flow loop rather than an average temperature.

Table 2, also shown below, presents heavy oil/gas flow pressure drop data for various oil and gas rates. Pressure drop predictions by two multiphase flow methods, namely SRTCA version 2.2 and GZM methods, are also presented.

TABLE 1

Measured Pressure Drop Data and Comparisons to Predictions for 100% Heavy Oil Flow.

| Oil Rate gpm | Avg. Temp. F. | Avg. Visc. cp | Hor. DP/DZ psi/ft | Pred. Hor. DP/DZ psi/ft | Vert. DP/DZ psi/ft | Pred. Vert. DP/DZ psi/ft | VL ft/s | REYNOLDS NUMBER | Friction Factor |
|---|---|---|---|---|---|---|---|---|---|
| 12.4 | 99 | 7592.8 | 6.553 | 7.092 | 6.59 | 7.515 | 2.66 | 3.652 | 4.381 |
| 11.07 | 99.165 | 7522.5 | 5.96 | 6.272 | 6.162 | 6.696 | 2.375 | 3.291 | 4.826 |
| 8.59 | 100.1 | 7136.9 | 4.278 | 4.618 | 4.637 | 5.041 | 1.843 | 2.692 | 5.944 |
| 6.431 | 101.2 | 6708.3 | 3.223 | 3.249 | 3.62 | 3.673 | 1.38 | 2.144 | 7.463 |
| 4.17 | 101.2 | 6708.3 | 2.192 | 2.107 | 2.614 | 2.531 | 0.895 | 1.39 | 11.509 |
| 2.27 | 101.2 | 6708.3 | 1.137 | 1.147 | 1.574 | 1.57 | 0.487 | 0.757 | 21.142 |
| 12.4 | 104.028 | 5720.8 | 5.965 | 5.343 | 6.13 | 5.767 | 2.66 | 4.848 | 3.301 |
| 11.07 | 107.395 | 4733 | 4.815 | 3.947 | 5.097 | 4.37 | 2.375 | 5.231 | 3.059 |
| 8.59 | 106.73 | 4913.6 | 3.547 | 3.179 | 3.923 | 3.603 | 1.843 | 3.91 | 4.092 |

TABLE 1-continued

Measured Pressure Drop Data and Comparisons to Predictions for 100% Heavy Oil Flow.

| Oil Rate gpm | Avg. Temp. F. | Avg. Visc. cp | Hor. DP/DZ psi/ft | Pred. Hor. DP/DZ psi/ft | Vert. DP/DZ psi/ft | Pred. Vert. DP/DZ psi/ft | VL ft/s | REYNOLDS NUMBER | Friction Factor |
|---|---|---|---|---|---|---|---|---|---|
| 6.431 | 106.48 | 4983.2 | 2.688 | 2.414 | 3.094 | 2.837 | 1.38 | 2.886 | 5.544 |
| 4.17 | 105.766 | 5187.6 | 1.845 | 1.629 | 2.275 | 2.053 | 0.895 | 1.798 | 8.9 |
| 2.27 | 106.487 | 4981.2 | 0.969 | 0.852 | 1.421 | 1.275 | 0.487 | 1.019 | 15.699 |

TABLE 2

Steady-State Flow Results for Heavy-oil and Nitrogen

| Oil Rate gpm | Gas Rate scfpm | VSL ft/s | VSG ft/s | Inlet Pres. psig | Horiz. DP/DZ psi/ft | GZM_Hor. DP/DZ psi/ft | SRTCA Horiz. DP/DZ, psi/ft | Vert. DP/DZ psi/ft | GZM_Vert. DP/DZ psi/ft | SRTCA Vert. DP/DZ, psi/ft |
|---|---|---|---|---|---|---|---|---|---|---|
| 2.27 | 0 | 0.487 | 0.000 | 31.76 | 1.147 | 0.917 | 0.884 | 1.562 | 1.340 | 1.290 |
| 2.27 | 2.1 | 0.487 | 1.227 | 26.49 | 1.081 | 0.883 | 3.092 | 1.149 | 1.482 | 1.375 |
| 2.27 | 4.9 | 0.487 | 2.909 | 25.80 | 1.060 | 0.920 | 6.352 | 1.060 | 1.697 | 1.354 |
| 2.27 | 3.5 | 0.487 | 2.065 | 26.10 | 1.067 | 0.884 | 4.597 | 1.120 | 1.575 | 1.332 |
| 4.17 | 0 | 0.895 | 0.000 | 60.18 | 2.398 | 1.614 | 1.614 | 2.737 | 2.038 | 2.037 |
| 4.17 | 2 | 0.895 | 0.663 | 56.52 | 2.480 | 1.543 | 2.677 | 2.247 | 2.038 | 2.326 |
| 4.17 | 3.7 | 0.895 | 1.249 | 55.21 | 2.433 | 1.596 | 3.803 | 2.204 | 2.191 | 2.346 |
| 4.17 | 2.8 | 0.895 | 0.971 | 53.56 | 2.353 | 1.495 | 3.104 | 2.129 | 2.031 | 2.232 |
| 6.431 | 0 | 1.380 | 0.000 | 76.99 | 3.090 | 2.347 | 2.346 | 3.426 | 2.771 | 2.769 |
| 6.431 | 2 | 1.380 | 0.516 | 76.57 | 3.308 | 2.415 | 3.310 | 3.096 | 2.900 | 3.660 |
| 6.431 | 3.1 | 1.380 | 0.839 | 72.57 | 3.159 | 2.183 | 3.499 | 2.910 | 2.679 | 3.817 |
| 6.431 | 2.6 | 1.380 | 0.727 | 69.91 | 3.030 | 2.091 | 3.184 | 2.841 | 2.564 | 3.512 |
| 8.59 | 0 | 1.843 | 0.000 | 88.29 | 3.563 | 3.007 | 3.006 | 3.901 | 3.431 | 3.429 |
| 8.59 | 2 | 1.843 | 0.464 | 87.14 | 3.734 | 2.658 | 3.322 | 3.548 | 3.118 | 3.688 |
| 8.59 | 3 | 1.843 | 0.720 | 83.68 | 3.601 | 2.814 | 3.903 | 3.397 | 3.279 | 4.247 |
| 8.59 | 2.5 | 1.843 | 0.619 | 80.80 | 3.457 | 2.792 | 3.722 | 3.293 | 3.257 | 4.074 |
| 11.07 | 0 | 2.375 | 0.000 | 99.24 | 4.000 | 3.487 | 3.485 | 4.369 | 3.910 | 3.908 |
| 11.07 | 2.1 | 2.375 | 0.447 | 96.54 | 4.086 | 3.259 | 3.866 | 3.956 | 3.711 | 4.243 |
| 11.07 | 2.8 | 2.375 | 0.631 | 90.79 | 3.852 | 2.884 | 3.643 | 3.786 | 3.325 | 4.005 |
| 12.4 | 0 | 2.660 | 0.000 | 95.89 | 3.854 | 3.259 | 3.257 | 4.251 | 3.682 | 3.680 |
| 12.4 | 2 | 2.660 | 0.438 | 93.88 | 3.919 | 3.319 | 3.860 | 3.968 | 3.763 | 4.242 |
| 12.4 | 2.8 | 2.660 | 0.639 | 89.88 | 3.747 | 3.040 | 3.764 | 3.783 | 3.477 | 4.130 |
| 12.4 | 2.4 | 2.660 | 0.570 | 86.05 | 3.562 | 2.931 | 3.554 | 3.650 | 3.366 | 3.925 |
| 13.73 | 0 | 2.945 | 0.000 | 90.10 | 3.585 | 3.081 | 3.079 | 4.028 | 3.504 | 3.502 |
| 13.73 | 1 | 2.945 | 0.234 | 87.85 | 3.614 | 2.981 | 3.215 | 3.772 | 3.411 | 3.616 |
| 13.73 | 2 | 2.945 | 0.483 | 84.93 | 3.466 | 2.857 | 3.321 | 3.657 | 3.285 | 3.703 |
| 13.73 | 3 | 2.945 | 0.752 | 81.51 | 3.305 | 2.746 | 3.439 | 3.576 | 3.165 | 3.803 |

Figure 13A:
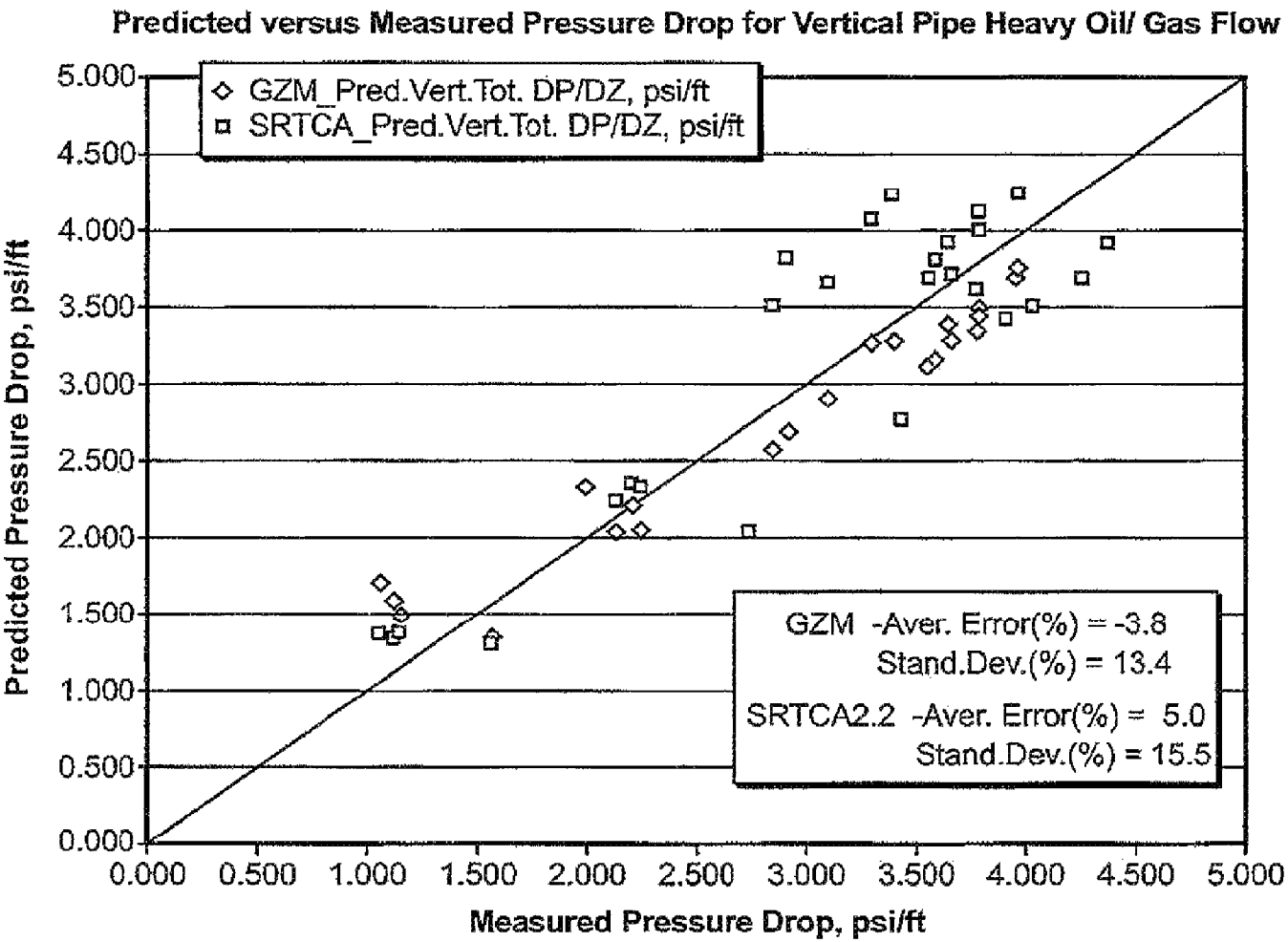
FIGS. 13A and 13B show graphs displaying predicted pressure drops versus measured pressure drops in accordance with an embodiment of the present disclosure.
Figure 13B:
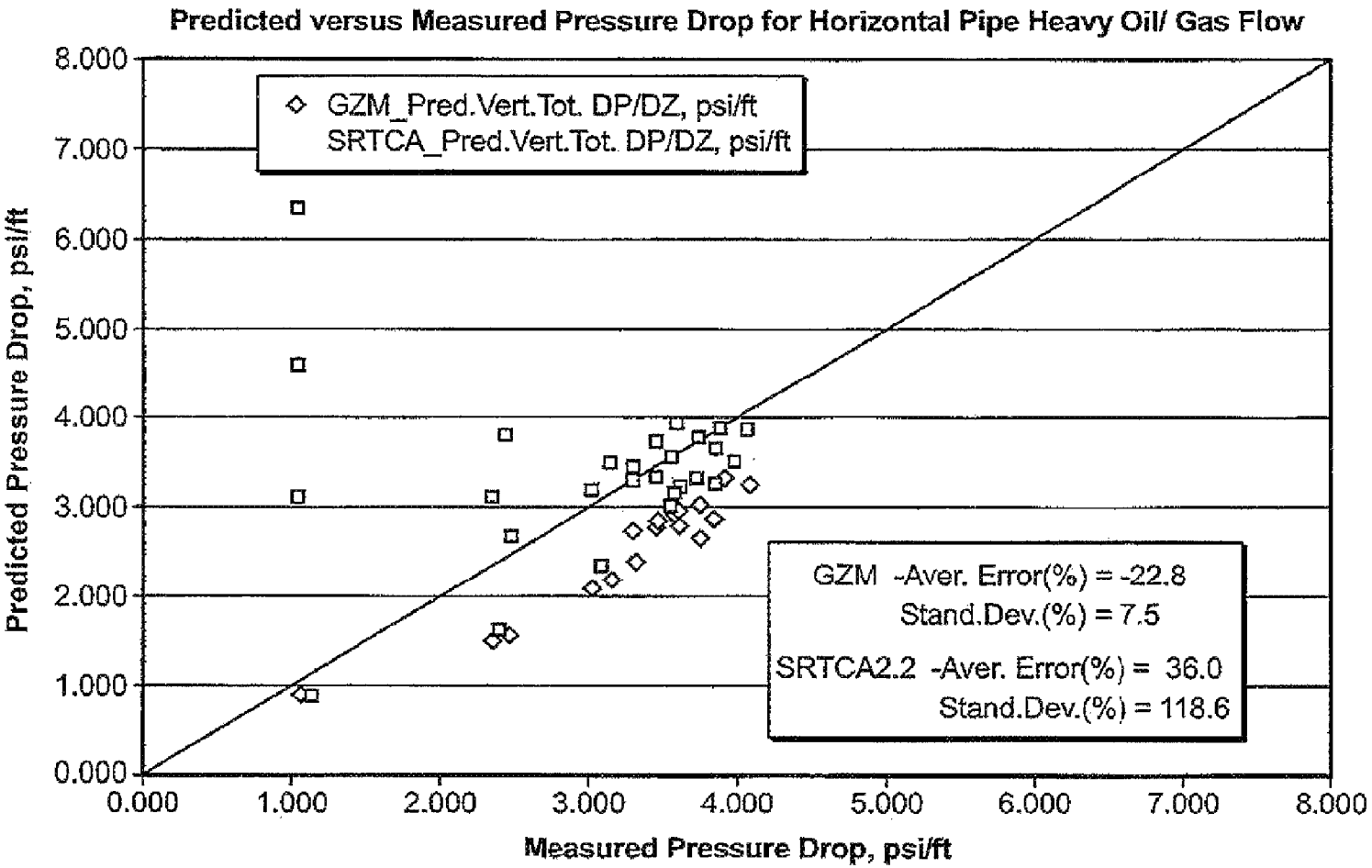

Further, the pressure drop comparison results are shown graphically in FIGS. 13A and 13B. Predicted horizontal pressure drops by GZM have an average error of −22% and a standard deviation of 7.5% (see FIGS. 13A and 13B). In contrast the SRTCA method has an average error of 36% and an associated standard deviation of 118.6% for the horizontal pipe data (see FIGS. 13A and 13B). The much worse error statistics for the SRTCA method are due to flow pattern misidentification for the lowest two oil rates. Dispersed bubble flow is predicted instead of slug flow. Both the SRTCA and GZM method prediction accuracy is better with the vertical flow data. GZM is still better predicting with an average error of −3.8% and a standard deviation of 13.4% (see FIGS. 13A and 13B). The success in the prediction of the vertical pipe pressure drops is somewhat surprising in view of the complexity of the heavy-oil/gas flow behavior and it does reassure us that gas-lift predictions particularly those of the GZM method should be reasonably accurate. Despite the relative success of both the GZM and the SRTCA multiphase flow models in predicting vertical pressure drop with heavy oil/gas flow, neither model is satisfactory under conditions different of our flow loop. For example, it appears that the SRTCA method predicts non-physical frictional pressure drops under some slug flow conditions (i.e. negative frictional pressure drop). Furthermore, when specifying an oil viscosity over 10000 cp in the SRTCA method identical results are obtained as with a viscosity of 10000 cp as if an internal model switch arbitrarily limits the viscosity to 10000 cp. The GZM model predicts unrealistic pressure drop results for conditions in the annular mist flow regime. GZM pressure drop predictions for annular-mist flow are relatively insensitive to liquid viscosity.

Limits of Gas-Lift with Heavy Oils

Figure 14:
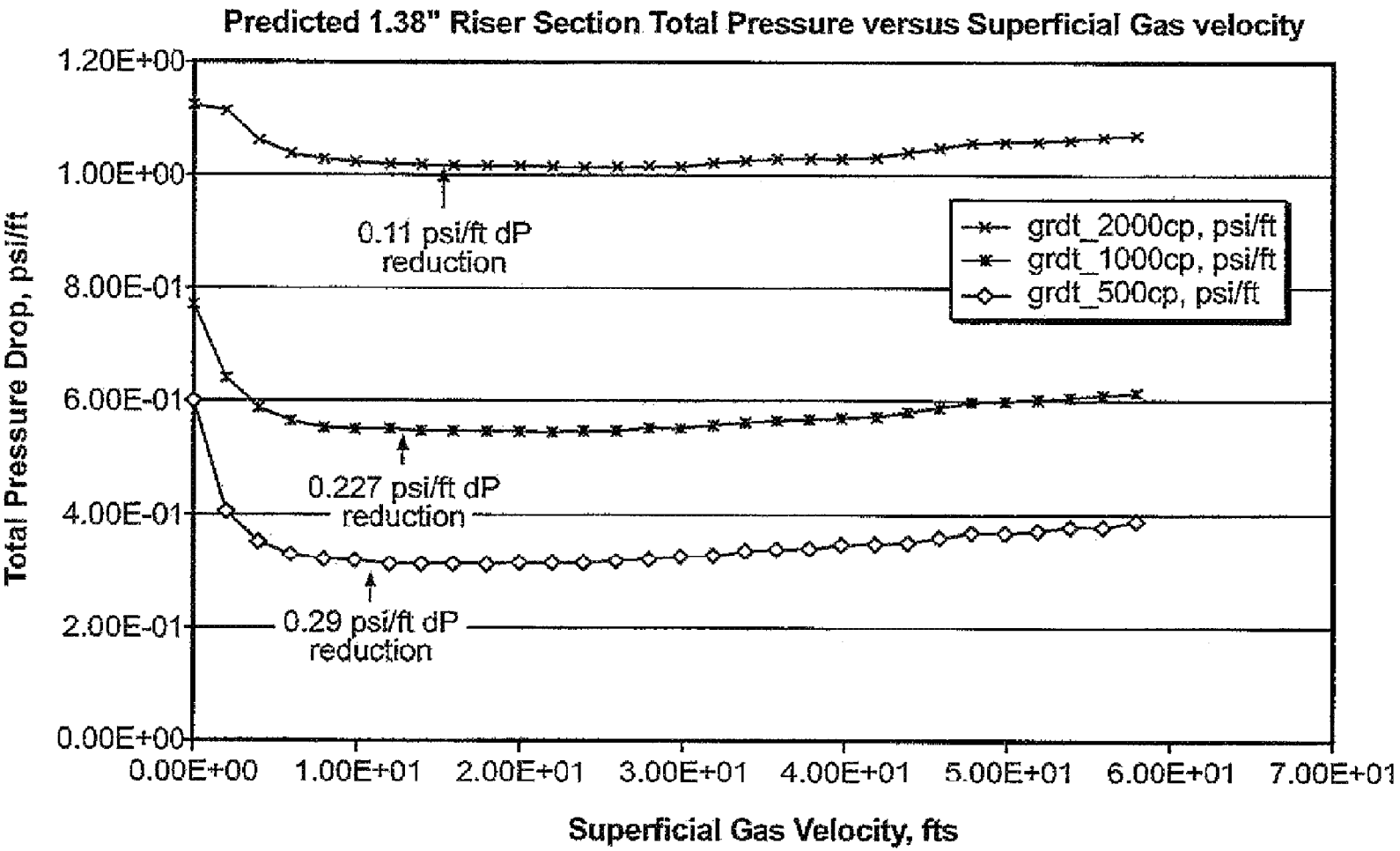
FIG. 14 shows a graph displaying predicted riser section pressure drop versus superficial gas velocity in accordance with an embodiment of the present disclosure.
Figure 15A:
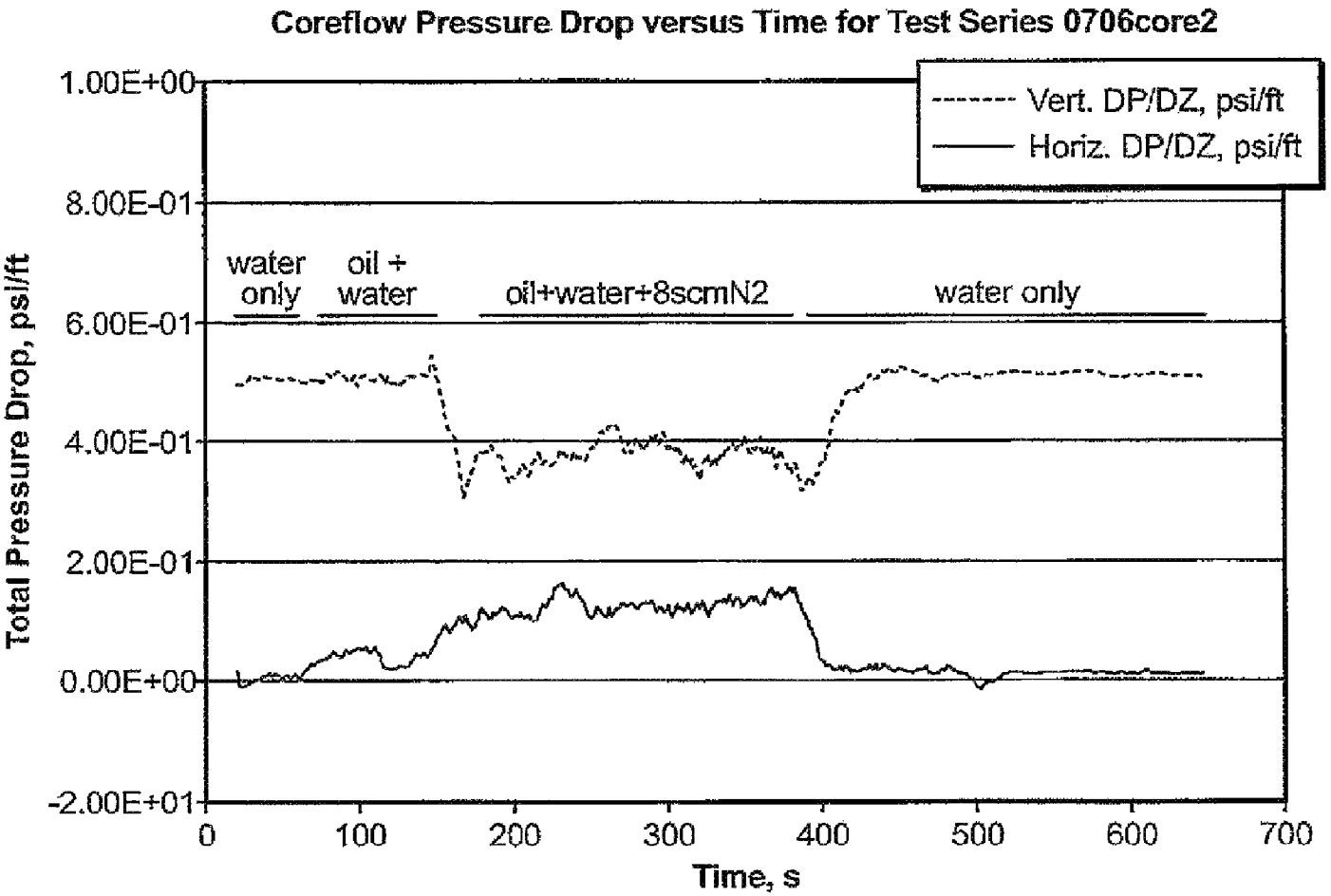
FIGS. 15A and 15B show graphs displaying core flow pressure drops versus time in accordance with an embodiment of the present disclosure.
Figure 15B:
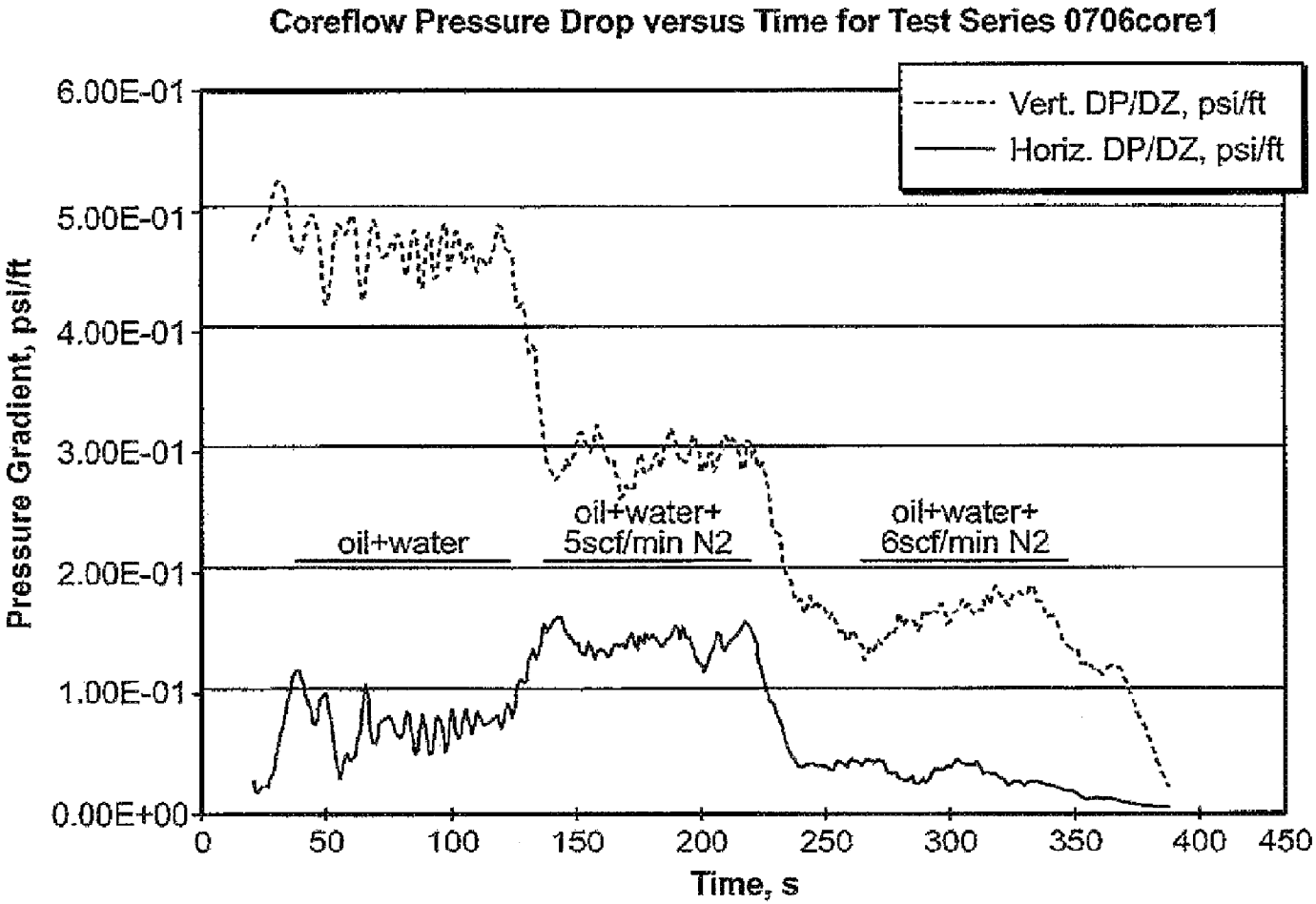
Figure 16A:
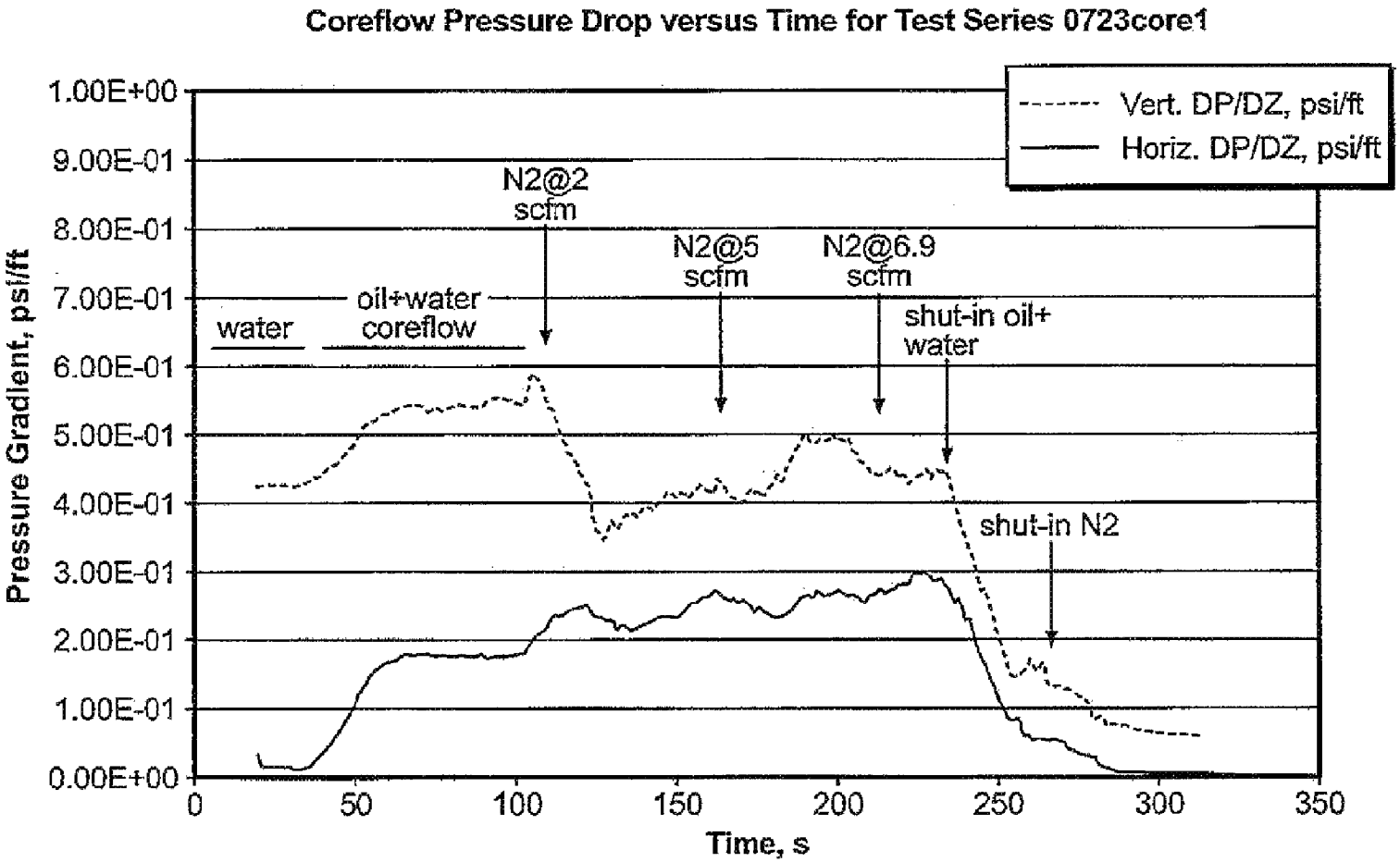
FIGS. 16A and 16B show graphs displaying core flow pressure drops versus time in accordance an embodiment of the present disclosure.
Figure 16B:
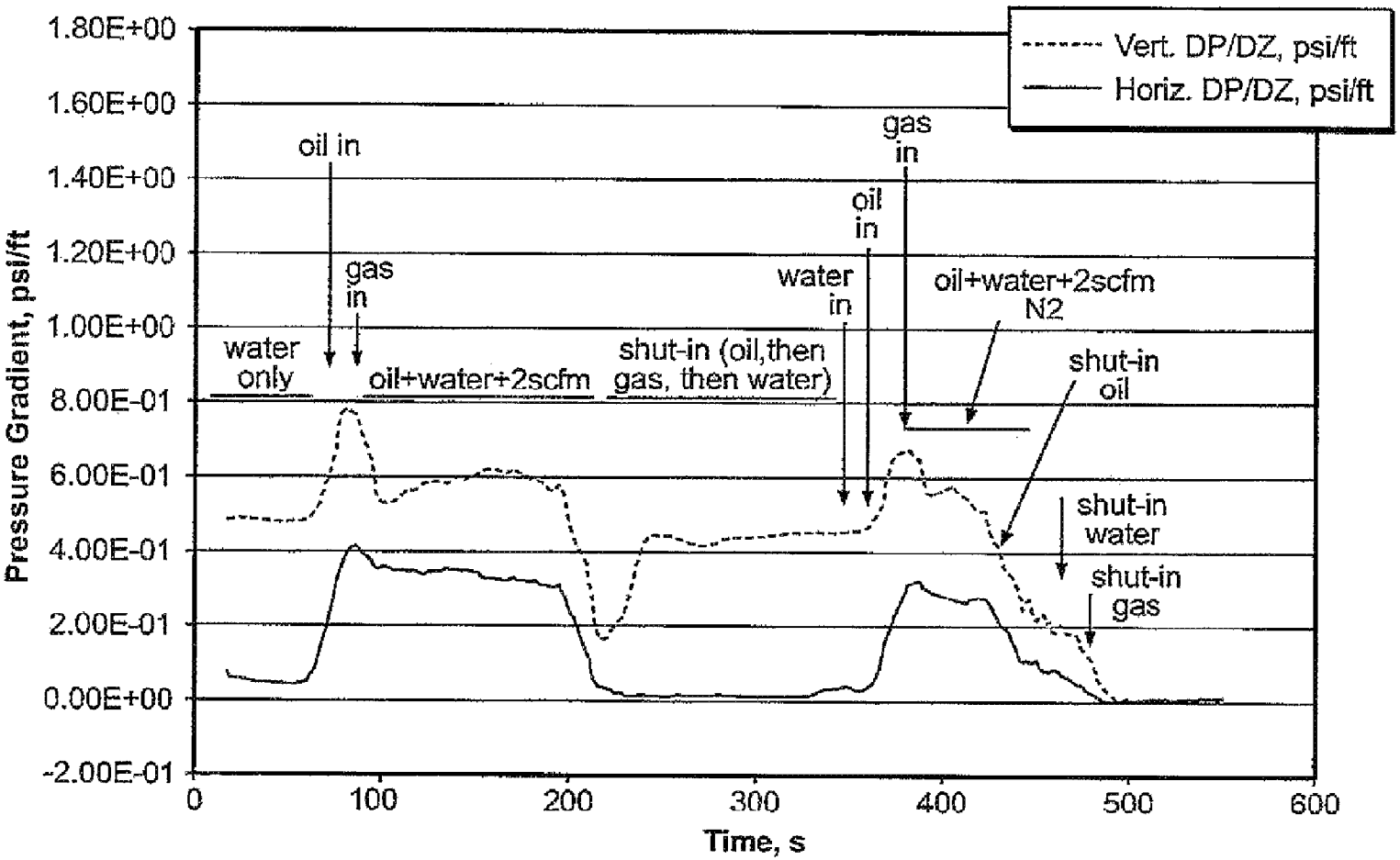

Gas-lift as an artificial lift method is primarily used to reduce the hydrostatic head in wells and risers. This pressure drop reduction can be significant especially in wells with low produced gas to oil ratio. It is not unusual that reductions of more than 90% in the riser or tubing hydrostatic head can be achieved in medium and light crude gas-lift applications without any appreciable increase in frictional pressure drop. However, when gas-lift is applied with heavy crudes, the reduction of the total pressure drop is limited. The reason is that although gas-lift can reduce the hydrostatic head by 90% or more, the frictional pressure drop increases simultaneously with the net result of a rather modest total pressure drop reduction. This is shown graphically in FIG. 14, in which the pressure drop in our riser section is being predicted as a function of the superficial gas velocity for an oil superficial velocity of 1 ft/s (rate of 4.7 gpm). As FIG. 14 shows, the pressure drop curve passes through a minimum that corresponds to the optimum total gas velocity. This optimum velocity increases with increasing oil viscosity. Furthermore, the pressure drop reduction (compared to the zero gas velocity case) also decreases with increasing oil viscosity. For example, for the 2000 cp case the maximum pressure drop reduction is 0.11 psi/ft, for 1000 cp is 0.227 psi/ft and for 500 cp it is 0.29 psi/ft. Curves such as those of FIG. 14 are usually designated as tubing or riser flow performance curves and are very useful in assessing the impact of gas-lift. Construction of flow performance curves for risers and/or wells requires the use of a multiphase flow simulator program. Attempts to use the program PIPESIM for heavy-oil riser flow performance curves demonstrated some serious technology gaps. These can be summarized as follows:

1. Simulator fluid PVT prediction package cannot handle high oil viscosity (user cannot tune viscosity prediction with know viscosity versus temperature data).
2. Simulators such as PIPESIM predict erroneous tubing or riser performance curves for viscous oils.
3. Specific flow models within the simulator such as the SRTCA flow correlation appear to give the same pressure drop results for viscosities larger than 10000 cp as with 10000 cp.
4. Flow models such as the SRTCA method predict non-physical pressure drop results for a range of slug flow conditions (i.e. negative frictional pressure drop).
5. Flow models such as the GZM model do not adequately model the annular-mist flow regime for heavy oils (i.e. predictions of pressure drop are not too sensitive on oil viscosity for annular-mist flow).
6. Certain flow regimes existing and modeled for medium and low viscosity crudes do not exist for heavy oils (for example dispersed bubble flow, mist flow etc.).

It is recommended that the basic multiphase flow modeling work be undertaken to improve the predictive ability of current models with high viscosity oils. The data gathered during this work can provide a basis for future multiphase model enhancement.

Oil-Water Coreflow

Coreflow is a very attractive flow regime because of the large pressure drop reduction that can be obtained. While earlier research and development work has adequately addressed the flow fundamentals and the operational aspects of coreflow, certain technology gaps existed and those were addressed in the present work. Such gaps included:

1. Effect of simultaneous gas flow
2. Effect of pipe inclination
3. Coreflow restart in the vertical inclination with and without cocurrent gas flow.

Table 3, shown on the following pages, presents all the coreflow data gathered during this work. This data is also graphically displayed in FIGS. 15A, 15B, 16A, and 16B.

TABLE 3

Oil-water-gas Coreflow Test Results

| Data Series | Oil Rate gpm | Water Rate gpm | Gas Rate scf/min | Inlet Pres. psig | Avg. Temp. F. | Avg. Visc. cp | Hor. DP/DZ psi/ft | Vert. DP/DZ psi/ft | Pred. DP/DZ - 100% oil Horiz. psi/ft | Pred. DP/DZ - 100% oil Vertical DP/DZ, psi/ft | Hor. Fric. DP Ratio Oil/coreflow | VSO ft/s | VSW ft/s | VSG ft/s |
|---|---|---|---|---|---|---|---|---|---|---|---|---|---|---|
| 0629core01 | 7.6 | 2.27 | 0 | 5.18 | 88.5 | 14199 | 0.008 | 0.450 | 8.123 | 8.549 | 1068.842 | 1.630 | 0.487 | 0.000 |
| 0702core01 | 7.5 | 1.8 | 0 | 6.06 | 91.5 | 11381 | 0.062 | 0.506 | 6.806 | 7.232 | 110.424 | 1.609 | 0.386 | 0.000 |
| | 7.5 | 1.8 | 2 | 5.08 | 90.7 | 12055 | 0.098 | 0.361 | 6.830 | 8.190 | 69.960 | 1.609 | 0.386 | 2.494 |
| 0706core1 | 7.5 | 2.5 | 0 | 6 | 103.0 | 5492 | 0.074 | 0.466 | 3.100 | 3.525 | 41.987 | 1.609 | 0.536 | 0.000 |
| | 7.5 | 2.5 | 5 | 4.93 | 102.0 | 5814 | 0.142 | 0.295 | 3.308 | 4.285 | 23.228 | 1.609 | 0.536 | 6.376 |
| | 7.5 | 2.5 | 6 | 2.14 | 105.0 | 4918 | 0.033 | 0.164 | 2.807 | 3.629 | 84.550 | 1.609 | 0.536 | 9.086 |
| 0706core2 | 7.5 | 2.2 | 0 | 5.6 | 107.0 | 4422 | 0.039 | 0.504 | 2.496 | 2.922 | 64.000 | 1.609 | 0.472 | 0.000 |
| | 7.5 | 2.2 | 7.55 | 5.18 | 111.0 | 3617 | 0.122 | 0.375 | 2.065 | 2.761 | 16.926 | 1.609 | 0.472 | 9.686 |
| 0708core1 | 9.4 | 2.35 | 0 | 7.82 | 93.0 | 10244 | 0.105 | 0.573 | 7.248 | 7.674 | 69.029 | 2.016 | 0.504 | 0.000 |
| | 9.4 | 2.35 | 2 | 6.78 | 93.5 | 9898 | 0.166 | 0.398 | 7.020 | 8.065 | 42.366 | 2.016 | 0.504 | 2.293 |
| | 9.4 | 2.35 | 5 | 6.84 | 92.0 | 10984 | 0.182 | 0.363 | 7.815 | 9.444 | 42.938 | 2.016 | 0.504 | 5.690 |
| 0712core1 | 9.4 | 2.675 | 0 | 6.93 | 83.0 | 22203 | 0.149 | 0.425 | 15.710 | 16.136 | 105.791 | 2.016 | 0.574 | 0.000 |
| | 9.4 | 2.675 | 2.3 | 6.61 | 83.0 | 22203 | 0.251 | 0.245 | 15.753 | 17.958 | 62.811 | 2.016 | 0.574 | 2.581 |
| | 9.4 | 2.675 | 5.5 | 6.12 | 82.0 | 24238 | 0.256 | 0.243 | 17.254 | 20.818 | 67.320 | 2.016 | 0.574 | 6.298 |
| | 9.4 | 2.675 | 7.3 | 6.34 | 82.0 | 24238 | 0.261 | 0.242 | 17.284 | 21.181 | 66.273 | 2.016 | 0.574 | 8.270 |
| 0712core2 | 12 | 3.1 | 0 | 7.63 | 94.0 | 9568 | 0.116 | 0.609 | 8.643 | 9.069 | 74.573 | 2.574 | 0.665 | 0.000 |
| | 12 | 3.1 | 2 | 7.33 | 95.0 | 8949 | 0.213 | 0.452 | 8.100 | 8.994 | 38.064 | 2.574 | 0.665 | 2.231 |
| | 12 | 3.1 | 5 | 8.48 | 97.5 | 7617 | 0.268 | 0.512 | 8.118 | 9.379 | 30.291 | 2.574 | 0.665 | 5.299 |
| | 12 | 3.1 | 6.4 | 9.11 | 102.0 | 5814 | 0.318 | 0.510 | 8.126 | 9.484 | 25.570 | 2.574 | 0.665 | 6.627 |
| 0723core1 | 14 | 3.5 | 0 | 7.95 | 92.0 | 10984 | 0.149 | 0.525 | 11.576 | 12.002 | 77.483 | 3.003 | 0.751 | 0.000 |
| | 14 | 3.5 | 2 | 8.02 | 94.5 | 9251 | 0.236 | 0.392 | 9.768 | 10.629 | 41.320 | 3.003 | 0.751 | 2.157 |
| | 14 | 3.5 | 5 | 8.69 | 97.0 | 7861 | 0.250 | 0.456 | 9.786 | 11.038 | 39.160 | 3.003 | 0.751 | 5.258 |
| | 14 | 3.5 | 6.9 | 9.11 | 97.2 | 7762 | 0.280 | 0.454 | 9.797 | 11.187 | 35.014 | 3.003 | 0.751 | 7.112 |
| 0723core2 | 12 | 3 | 0 | 7.37 | 105.0 | 4918 | 0.107 | 0.612 | 4.442 | 4.869 | 41.592 | 2.574 | 0.644 | 0.000 |
| | 12 | 3 | 2 | 7.39 | 105.0 | 4918 | 0.187 | 0.486 | 4.452 | 5.056 | 23.757 | 2.574 | 0.644 | 2.271 |
| | 12 | 3 | 5 | 7.2 | 105.0 | 4918 | 0.169 | 0.521 | 4.463 | 5.243 | 26.346 | 2.574 | 0.644 | 5.738 |
| | 12 | 3 | 7 | 7.07 | 105.0 | 4918 | 0.185 | 0.5 | 4.470 | 5.316 | 24.201 | 2.574 | 0.644 | 8.067 |

A total of nine series of tests were conducted. Oil superficial velocities varied in the range from 1.6 to 3 ft/s. The water volume fraction compared to total liquid volume remained close to 20% for all tests. Gas superficial velocities varied from 0 to 9 ft/s. No effort was made to thoroughly clean the pipe wall before each test. Therefore, it is envisioned that small portions of the wall may have been coated with oil during this testing program. Such partial oil coating is expected to give higher frictional pressure drops than what has been demonstrated in the literature for clean glass pipes. Despite of this, achieved frictional pressure drops for the present coreflow tests with or without gas are many times smaller than for flow of oil alone. Predicted oil only frictional pressure drops are 17 to 1070 times higher than those achieved by coreflow as Table 3 shows. The data of Table 3 also suggest that the vertical coreflow frictional pressure drop is comparable to the horizontal pressure drop. The introduction of gas flow into an oil-water coreflow stream is to generally increase the frictional pressure gradient. Such an increase however, is for the vertical pipe section smaller than the reduction in the hydrostatic pressure gradient. All the flow conditions with gas were in the slug flow regime as manifested by the periodic noise heard during the tests. As this Figure indicates, the coreflow restart following a flow shut-in was successful. Several other similar restart tests were conducted they demonstrate successfully the ability to restart coreflow with or without gas. This is the first time that such successful restart tests were carried out with both simultaneous gas flow and with a vertical pipe section where the phase separation during shutdown was thought of previously as a major problem for successful coreflow restart.

Oil-Water Emulsion Flow

Water-continuous emulsion flow is an attractive technique for lifting and transportation of heavy oils. However, most produced water-oil streams are essentially in the form of oil-continuous emulsions. This indicates that most produced heavy oils have components that are natural emulsifiers. Therefore, achieving a water-continuous emulsion relies on the addition of emulsifying chemicals to the produced stream to create a reverse emulsion (i.e. water-continuous). Such reverse emulsions can be spontaneously created only at high watercut, typically larger than 70%. Achieving a reverse emulsion at lower watercut almost always requires addition of suitable emulsifiers. A great deal of published works was referenced earlier in this report and describes successful efforts to produce water-continuous emulsions with the use of varying amounts of specialty chemicals. Three different chemicals were identified from prior experience with heavy oils from onshore fields in California. One is a water-dispersible demulsifier (i.e. assists in breaking down typical oil-continuous oilfield emulsions). Another is a water-soluble asphaltic oil emulsifier (assists in creating water-continuous emulsion with heavy, asphaltic crude oils) and the third chemical is a water-soluble surfactant polymer with molecular weight distribution between 10000 and 1000000. In the following discussion because of pending intellectual property issues, these chemicals are designated as FF, PA and HC. All three are commercial products and are readily available through oilfield chemical vendors. A concentration of 500 ppm was used for chemical FF based on total liquid weight (oil+water). Similarly a concentration of 300 ppm was used for chemical PA and 20 ppm based on total fluid was used for chemical HC. Prior to flow tests, extremely tight oil-continuous emulsions were prepared by circulating the oil/water mixture through the oil gear pump for several hours. Emulsions produced in this way were stable for many days. Viscosity measurements were carried out for the various emulsions produced with a Brookfield Programmable DV-II viscometer. It was observed that for a given watercut the emulsion viscosity could vary depending on the emulsion history. For example, higher emulsion viscosities were found for emulsions that were recirculated through the oil gear pump the most times Limited emulsion viscosity data taken with representative stable emulsion samples are shown in Table 4 below.

TABLE 4

Viscosity Measurement for Oil-Continuous Emulsion

| | Emulsion Viscosity in cp at various water cut values | | | | | |
|---|---|---|---|---|---|---|
| Temp. F. | 32% | 35% | 40% | 45% | 50% | 0% |
| 80 | 105000 | 111000 | 120812 | 173000 | 191000 | 28275 |
| 100 | 26514 | 30593 | 30051 | 44590 | 58847 | 7009 |
| 120 | 7968 | 9288 | 9347 | 14412 | 18276 | 2317 |
| 140 | 3251 | 3434 | 3613 | 5405 | 7030 | 960 |

Figure 17:
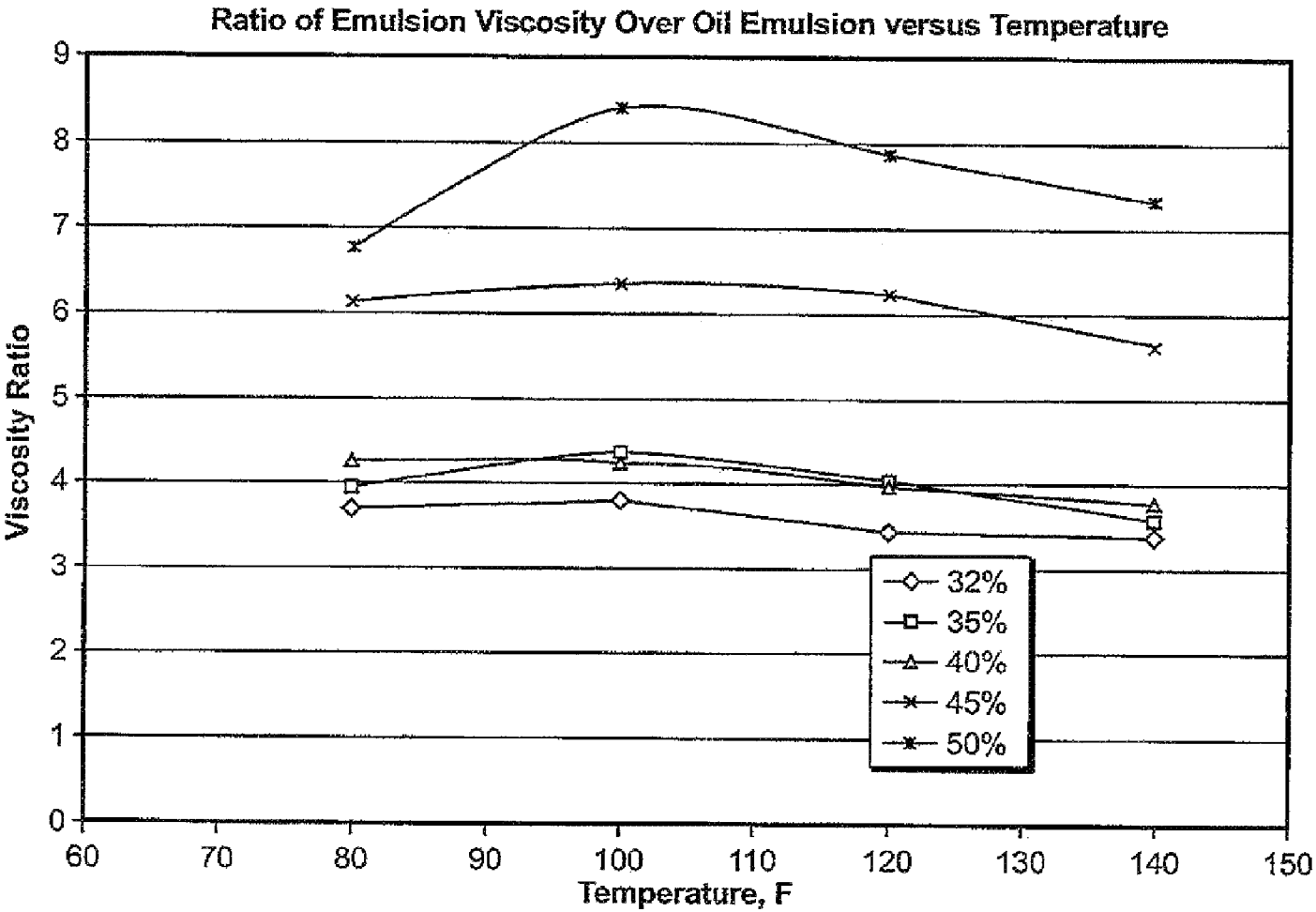
FIG. 17 shows a graph displaying ratio of emulsion viscosity over oil emulsion versus temperature in accordance with an embodiment of the present disclosure.

A few of these viscosity measurements were closely reproduced with the capillary tube technique. FIG. 17 displays the ratio of the emulsion to oil viscosity for various temperatures. It appears that the emulsions generated for the present work had viscosities 3.4 to 8.4 times higher than the oil viscosity. It is unlikely that such tight emulsions will exist in the field unless perhaps the produced oil and water are passed through a multistage electrical submersible pump (ESP). Nevertheless, for the purpose of our testing the generated emulsions represent a conservative basis.

Table 5, shown on the following pages, presents all the emulsion flow conditions studied.

TABLE 5

Listing of Emulsion Flow Tests with three Chemical Additives

| | | | | | | | | | | | Pred. DP/DZ | | | | | |
|---|---|---|---|---|---|---|---|---|---|---|---|---|---|---|---|---|
| Data Series | Total Liq. Rate gpm | Water Rate gpm | water-cut % | Chemical added | Gas Rate scf/min | Inlet Pres. psig | Avg. Temp. F. | Avg. Visc. cp | Hor. DP/DZ psi/ft | Vert. DP/DZ psi/ft | Horiz. psi/ft | Vertical psi/ft | Friction DP Ratio | VSO ft/s | VSW ft/s | VSG ft/s |
| 0927B | 2.270 | 1.022 | 45 | FF + PA + HC | 0 | 6.5 | 107.2 | 32634 | 0.062 | 0.481 | 3.071 | 3.499 | 49.832 | 0.268 | 0.219 | 0.000 |
| | 4.170 | 1.877 | 45 | FF + PA + HC | 0 | 6.6 | 105.7 | 35664 | 0.060 | 0.489 | 6.161 | 6.589 | 102.730 | 0.492 | 0.403 | 0.000 |
| | 6.431 | 2.894 | 45 | FF + PA + HC | 0 | 8.2 | 106.0 | 35104 | 0.129 | 0.548 | 9.3554 | 9.7833 | 72.363 | 0.759 | 0.621 | 0.000 |
| | 8.590 | 3.866 | 45 | FF + PA + HC | 0 | 9.6 | 105.3 | 36468 | 0.217 | 0.574 | 12.971 | 13.399 | 59.703 | 1.013 | 0.829 | 0.000 |
| | 11.070 | 4.982 | 45 | FF + PA + HC | 0 | 18.0 | 105.9 | 35251 | 0.681 | 0.759 | 16.165 | 16.593 | 23.750 | 1.306 | 1.069 | 0.000 |
| | 12.400 | 5.580 | 45 | FF + PA + HC | 0 | 24.8 | 106.7 | 33617 | 0.807 | 1.276 | 17.269 | 17.697 | 21.390 | 1.463 | 1.197 | 0.000 |
| | 13.730 | 6.179 | 45 | FF + PA + HC | 0 | 25.3 | 105.6 | 35964 | 0.799 | 1.345 | 20.457 | 20.885 | 25.610 | 1.620 | 1.325 | 0.000 |
| 0927C | 2.270 | 1.022 | 45 | FF + PA + HC | 0 | 9.4 | 105.8 | 35439 | 0.121 | 0.670 | 3.335 | 3.763 | 27.566 | 0.268 | 0.219 | 0.000 |
| | 2.270 | 1.022 | 45 | FF + PA + HC | 2 | 28.4 | 106.4 | 34228 | 1.431 | 0.855 | 5.190 | 5.405 | 3.627 | 0.268 | 0.219 | 1.101 |
| | 2.270 | 1.022 | 45 | FF + PA + HC | 4.5 | 31.3 | 111.0 | 26268 | 1.570 | 1.038 | 4.581 | 4.723 | 2.917 | 0.268 | 0.219 | 2.330 |
| | 2.270 | 1.022 | 45 | FF + PA + HC | 3 | 35.3 | 110.3 | 27401 | 1.701 | 1.355 | 4.373 | 4.561 | 2.571 | 0.268 | 0.219 | 1.429 |
| | 2.270 | 1.022 | 45 | FF + PA + HC | 4.5 | 33.2 | 113.2 | 23167 | 1.614 | 1.180 | 4.016 | 4.161 | 2.487 | 0.268 | 0.219 | 2.248 |
| | 4.170 | 1.877 | 45 | FF + PA + HC | 0 | 9.7 | 111.1 | 26185 | 0.125 | 0.684 | 4.524 | 4.952 | 36.071 | 0.492 | 0.403 | 0.000 |
| | 4.170 | 1.877 | 45 | FF + PA + HC | 2 | 31.3 | 113.8 | 22328 | 1.534 | 1.110 | 4.924 | 5.178 | 3.210 | 0.492 | 0.403 | 1.044 |
| | 4.170 | 1.877 | 45 | FF + PA + HC | 3.75 | 38.9 | 111.3 | 25851 | 2.119 | 1.056 | 6.061 | 6.269 | 2.860 | 0.492 | 0.403 | 1.649 |

TABLE 5-continued

Listing of Emulsion Flow Tests with three Chemical Additives

| Data Series | Total Liq. Rate gpm | Water Rate gpm | water-cut % | Chemical added | Gas Rate scf/min | Inlet Pres. psig | Avg. Temp. F. | Avg. Visc. cp | Hor. DP/DZ psi/ft | Vert. DP/DZ psi/ft | Pred. DP/DZ Horiz. psi/ft | Pred. DP/DZ Vertical psi/ft | Friction DP Ratio | VSO ft/s | VSW ft/s | VSG ft/s |
|---|---|---|---|---|---|---|---|---|---|---|---|---|---|---|---|---|
| | 4.170 | 1.877 | 45 | FF + PA + HC | 3 | 42.4 | 116.9 | 18739 | 2.279 | 1.240 | 4.233 | 4.469 | 1.857 | 0.492 | 0.403 | 1.249 |
| | 6.431 | 2.894 | 45 | FF + PA + HC | 0 | 13.5 | 115.3 | 20463 | 0.211 | 0.943 | 5.454 | 5.882 | 25.906 | 0.759 | 0.621 | 0.000 |
| | 6.431 | 2.894 | 45 | FF + PA + HC | 2 | 36.2 | 120.0 | 15640 | 1.499 | 1.529 | 4.776 | 5.066 | 3.186 | 0.759 | 0.621 | 0.961 |
| | 6.431 | 2.894 | 45 | FF + PA + HC | 4 | 42.1 | 120.9 | 14893 | 1.979 | 1.621 | 4.796 | 5.030 | 2.423 | 0.759 | 0.621 | 1.705 |
| | 6.431 | 2.894 | 45 | FF + PA + HC | 3 | 46.4 | 117.4 | 18142 | 2.132 | 1.721 | 5.642 | 5.913 | 2.646 | 0.759 | 0.621 | 1.181 |
| | 8.590 | 3.866 | 45 | FF + PA + HC | 0 | 11.4 | 118.8 | 16780 | 0.131 | 0.829 | 5.969 | 6.397 | 45.541 | 1.013 | 0.829 | 0.000 |
| | 8.590 | 3.866 | 45 | FF + PA + HC | 2 | 35.1 | 119.8 | 15801 | 1.340 | 1.679 | 6.174 | 6.481 | 4.609 | 1.013 | 0.829 | 0.989 |
| | 8.590 | 3.866 | 45 | FF + PA + HC | 4 | 44.5 | 120.1 | 15564 | 1.765 | 1.969 | 6.303 | 6.561 | 3.570 | 1.013 | 0.829 | 1.653 |
| | 8.590 | 3.866 | 45 | FF + PA + HC | 3 | 50.8 | 120.1 | 15595 | 1.922 | 2.271 | 6.144 | 6.439 | 3.197 | 1.013 | 0.829 | 1.121 |
| | 11.070 | 4.982 | 45 | FF + PA + HC | 0 | 16.0 | 116.5 | 19104 | 0.339 | 1.004 | 8.761 | 9.189 | 25.841 | 1.306 | 1.069 | 0.000 |
| | 11.070 | 4.982 | 45 | FF + PA + HC | 2 | 40.5 | 120.3 | 15414 | 1.349 | 1.894 | 7.516 | 7.847 | 5.570 | 1.306 | 1.069 | 0.898 |
| | 11.070 | 4.982 | 45 | FF + PA + HC | 3.75 | 53.1 | 118.7 | 16900 | 1.978 | 2.404 | 8.407 | 8.705 | 4.251 | 1.306 | 1.069 | 1.351 |
| | 11.070 | 4.982 | 45 | FF + PA + HC | 3 | 60.6 | 115.4 | 20435 | 2.198 | 2.991 | 9.998 | 10.323 | 4.548 | 1.306 | 1.069 | 0.968 |
| | 12.400 | 5.580 | 45 | FF + PA + HC | 0 | 20.4 | 115.0 | 20866 | 0.453 | 1.253 | 10.719 | 11.147 | 23.675 | 1.463 | 1.197 | 0.000 |
| | 12.400 | 5.580 | 45 | FF + PA + HC | 2 | 49.8 | 113.4 | 22828 | 1.660 | 2.567 | 12.278 | 12.626 | 7.395 | 1.463 | 1.197 | 0.757 |
| | 12.400 | 5.580 | 45 | FF + PA + HC | 3.7 | 63.9 | 113.3 | 23054 | 2.538 | 2.705 | 12.593 | 12.913 | 4.962 | 1.463 | 1.197 | 1.131 |
| | 12.400 | 5.580 | 45 | FF + PA + HC | 3 | 69.4 | 114.8 | 21152 | 2.608 | 3.243 | 11.430 | 11.770 | 4.383 | 1.463 | 1.197 | 0.862 |
| | 13.730 | 6.179 | 45 | FF + PA + HC | 0 | 24.3 | 112.0 | 24878 | 0.573 | 1.431 | 14.151 | 14.579 | 24.698 | 1.620 | 1.325 | 0.000 |
| | 13.730 | 6.179 | 45 | FF + PA + HC | 2 | 66.9 | 110.2 | 27600 | 2.202 | 3.239 | 16.224 | 16.592 | 7.369 | 1.620 | 1.325 | 0.593 |
| | 13.730 | 6.179 | 45 | FF + PA + HC | 3.7 | 77.0 | 110.5 | 26993 | 3.098 | 3.255 | 16.096 | 16.435 | 5.195 | 1.620 | 1.325 | 0.962 |
| | 13.730 | 6.179 | 45 | FF + PA + HC | 3 | 86.1 | 110.9 | 26389 | 3.356 | 3.590 | 15.587 | 15.945 | 4.644 | 1.620 | 1.325 | 0.711 |
| 0929A | 2.270 | 1.022 | 45 | FF + PA + HC | 0 | 22.0 | 128.8 | 9437 | 0.672 | 1.219 | 0.888 | 1.316 | 1.320 | 0.268 | 0.219 | 0.000 |
| | 4.170 | 1.877 | 45 | FF + PA + HC | 0 | 35.7 | 131.3 | 8159 | 1.250 | 1.776 | 1.410 | 1.838 | 1.127 | 0.492 | 0.403 | 0.000 |
| | 6.431 | 2.894 | 45 | FF + PA + HC | 0 | 47.2 | 134.6 | 6757 | 1.723 | 2.276 | 1.800 | 2.228 | 1.045 | 0.759 | 0.621 | 0.000 |
| | 8.590 | 3.866 | 45 | FF + PA + HC | 0 | 57.0 | 135.7 | 6340 | 2.109 | 2.705 | 2.257 | 2.685 | 1.070 | 1.013 | 0.829 | 0.000 |
| | 11.070 | 4.982 | 45 | FF + PA + HC | 0 | 55.9 | 139.4 | 5104 | 1.603 | 3.111 | 2.341 | 2.769 | 1.461 | 1.306 | 1.069 | 0.000 |
| | 12.400 | 5.580 | 45 | FF + PA + HC | 0 | 45.7 | 142.1 | 4377 | 1.376 | 2.789 | 2.249 | 2.677 | 1.635 | 1.463 | 1.197 | 0.000 |
| | 13.730 | 6.179 | 45 | FF + PA + HC | 0 | 27.2 | 145.4 | 3624 | 0.901 | 1.458 | 2.062 | 2.490 | 2.290 | 1.620 | 1.325 | 0.000 |
| | 15.850 | 7.133 | 45 | FF + PA + HC | 0 | 31.9 | 143.3 | 4096 | 1.191 | 1.515 | 2.690 | 3.118 | 2.259 | 1.870 | 1.530 | 0.000 |
| 1005A | 2.270 | 0.726 | 32 | 500 ppm FF | 0 | 31.1 | 108.2 | 18022 | 0.974 | 1.581 | 2.003 | 2.430 | 2.055 | 0.331 | 0.156 | 0.000 |
| | 4.170 | 1.334 | 32 | 500 ppm FF | 0 | 45.3 | 109.3 | 16884 | 1.546 | 2.191 | 3.447 | 3.874 | 2.230 | 0.608 | 0.286 | 0.000 |
| | 6.431 | 2.058 | 32 | 500 ppm FF | 0 | 44.7 | 114.7 | 12323 | 1.334 | 2.355 | 3.880 | 4.307 | 2.908 | 0.938 | 0.441 | 0.000 |
| | 8.590 | 2.749 | 32 | 500 ppm FF | 0 | 26.0 | 118.8 | 9907 | 0.829 | 1.292 | 4.167 | 4.594 | 5.027 | 1.253 | 0.590 | 0.000 |
| | 11.070 | 3.542 | 32 | 500 ppm FF | 0 | 33.4 | 123.9 | 7679 | 1.152 | 1.561 | 4.162 | 4.589 | 3.614 | 1.615 | 0.760 | 0.000 |
| | 12.400 | 3.968 | 32 | 500 ppm FF | 0 | 35.9 | 124.6 | 7435 | 1.279 | 1.645 | 4.514 | 4.941 | 3.528 | 1.809 | 0.851 | 0.000 |
| | 13.730 | 4.394 | 32 | 500 ppm FF | 0 | 40.7 | 120.7 | 9002 | 1.489 | 1.822 | 6.052 | 6.479 | 4.063 | 2.003 | 0.943 | 0.000 |
| 1005B | 2.270 | 0.726 | 32 | 500 ppm FF | 0.000 | 31.8 | 97.0 | 39179 | 1.075 | 1.529 | 4.555 | 4.982 | 4.236 | 0.331 | 0.156 | 0.000 |
| | 2.270 | 0.726 | 32 | 500 ppm FF | 2.000 | 19.3 | 106.0 | 20783 | 0.648 | 0.845 | 2.416 | 2.843 | 3.729 | 0.331 | 0.156 | 1.440 |
| | 2.270 | 0.726 | 32 | 500 ppm FF | 5.300 | 19.2 | 109.8 | 16391 | 0.549 | 1.006 | 1.906 | 2.332 | 3.472 | 0.331 | 0.156 | 3.885 |
| | 2.270 | 0.726 | 32 | 500 ppm FF | 3.500 | 18.9 | 112.2 | 14202 | 0.596 | 0.943 | 1.651 | 2.078 | 2.769 | 0.331 | 0.156 | 2.584 |
| | 4.170 | 1.334 | 32 | 500 ppm FF | 0.000 | 50.3 | 111.1 | 15133 | 1.733 | 2.435 | 3.232 | 3.659 | 1.865 | 0.608 | 0.286 | 0.000 |
| | 4.170 | 1.334 | 32 | 500 ppm FF | 2.000 | 39.0 | 110.6 | 15622 | 1.516 | 1.667 | 3.337 | 3.763 | 2.202 | 0.608 | 0.286 | 0.899 |
| | 4.170 | 1.334 | 32 | 500 ppm FF | 4.000 | 39.2 | 111.2 | 15043 | 1.498 | 1.596 | 3.213 | 3.640 | 2.145 | 0.608 | 0.286 | 1.796 |
| | 4.170 | 1.334 | 32 | 500 ppm FF | 3.000 | 38.6 | 109.0 | 17200 | 1.522 | 1.581 | 3.674 | 4.100 | 2.414 | 0.608 | 0.286 | 1.355 |
| | 6.431 | 2.058 | 32 | 500 ppm FF | 0.000 | 75.1 | 112.7 | 13839 | 2.246 | 3.969 | 4.559 | 4.985 | 2.029 | 0.938 | 0.441 | 0.000 |
| | 6.431 | 2.058 | 32 | 500 ppm FF | 2.000 | 74.5 | 110.2 | 15964 | 3.190 | 2.858 | 5.258 | 5.685 | 1.648 | 0.938 | 0.441 | 0.532 |
| | 6.431 | 2.058 | 32 | 500 ppm FF | 3.400 | 68.0 | 110.6 | 15592 | 2.888 | 2.653 | 5.136 | 5.563 | 1.778 | 0.938 | 0.441 | 0.978 |
| | 6.431 | 2.058 | 32 | 500 ppm FF | 2.700 | 68.9 | 110.8 | 15422 | 2.934 | 2.622 | 5.080 | 5.507 | 1.732 | 0.938 | 0.441 | 0.768 |
| | 8.590 | 2.749 | 32 | 500 ppm FF | 0.000 | 98.9 | 111.1 | 15182 | 3.464 | 4.684 | 6.680 | 7.106 | 1.928 | 1.253 | 0.590 | 0.000 |
| | 8.590 | 2.749 | 32 | 500 ppm FF | 2.000 | 90.4 | 113.6 | 13135 | 3.866 | 3.496 | 5.779 | 6.206 | 1.495 | 1.253 | 0.590 | 0.453 |
| | 8.590 | 2.749 | 32 | 500 ppm FF | 3.000 | 89.4 | 113.6 | 13078 | 3.880 | 3.408 | 5.754 | 6.181 | 1.483 | 1.253 | 0.590 | 0.685 |
| | 8.590 | 2.749 | 32 | 500 ppm FF | 2.500 | 91.1 | 112.2 | 14224 | 3.975 | 3.435 | 6.258 | 6.685 | 1.574 | 1.253 | 0.590 | 0.560 |
| | 11.070 | 3.542 | 32 | 500 ppm FF | 0.000 | 129.4 | 112.8 | 13744 | 4.860 | 5.802 | 7.793 | 8.220 | 1.604 | 1.615 | 0.760 | 0.000 |
| | 11.070 | 3.542 | 32 | 500 ppm FF | 2.000 | 127.3 | 115.4 | 11884 | 5.445 | 4.951 | 6.738 | 7.165 | 1.237 | 1.615 | 0.760 | 0.335 |
| | 12.400 | 3.968 | 32 | 500 ppm FF | 0.000 | 148.4 | 114.3 | 12640 | 5.895 | 6.369 | 8.028 | 8.455 | 1.362 | 1.809 | 0.851 | 0.000 |
| | 13.730 | 4.394 | 32 | 500 ppm FF | 0.000 | 153.1 | 114.5 | 12477 | 6.044 | 6.624 | 8.774 | 9.201 | 1.452 | 2.003 | 0.943 | 0.000 |
| 1008A | 13.730 | 6.041 | 44 | 300 ppm PA | 0.000 | 15.8 | 102.7 | 25931 | 0.460 | 1.004 | 15.018 | 15.446 | 32.682 | 1.649 | 1.296 | 0.000 |
| | 12.040 | 5.298 | 44 | 300 ppm PA | 0.000 | 13.5 | 103.7 | 24174 | 0.382 | 0.890 | 12.277 | 12.705 | 32.164 | 1.446 | 1.136 | 0.000 |
| | 11.070 | 4.871 | 44 | 300 ppm PA | 0.000 | 17.4 | 104.2 | 23386 | 0.519 | 1.076 | 10.920 | 11.348 | 21.046 | 1.330 | 1.045 | 0.000 |
| | 8.590 | 3.780 | 44 | 300 ppm PA | 0.000 | 24.1 | 101.6 | 27900 | 0.827 | 1.279 | 10.109 | 10.537 | 12.222 | 1.032 | 0.811 | 0.000 |
| | 6.431 | 2.830 | 44 | 300 ppm PA | 0.000 | 21.4 | 104.3 | 23220 | 0.702 | 1.172 | 6.299 | 6.7266 | 8.978 | 0.773 | 0.607 | 0.000 |
| | 4.170 | 1.835 | 44 | 300 ppm PA | 0.000 | 17.1 | 102.9 | 25468 | 0.543 | 0.960 | 4.480 | 4.9076 | 8.244 | 0.501 | 0.394 | 0.000 |
| | 2.270 | 0.999 | 44 | 300 ppm PA | 0.000 | 11.0 | 101.4 | 28276 | 0.269 | 0.699 | 2.708 | 3.1354 | 10.084 | 0.273 | 0.214 | 0.000 |
| 1008B | 13.730 | 6.041 | 44 | 300 ppm PA | 0.000 | 42.5 | 100.2 | 30887 | 1.417 | 2.163 | 17.888 | 18.316 | 12.627 | 1.649 | 1.296 | 0.000 |
| | 13.730 | 6.041 | 44 | 300 ppm PA | 2.000 | 28.9 | 99.5 | 32612 | 0.676 | 2.008 | 19.907 | 20.235 | 29.460 | 1.649 | 1.296 | 1.119 |
| | 13.730 | 6.041 | 44 | 300 ppm PA | 5.000 | 29.5 | 99.4 | 32684 | 0.777 | 1.978 | 20.785 | 21.031 | 26.753 | 1.649 | 1.296 | 2.749 |
| | 13.730 | 6.041 | 44 | 300 ppm PA | 3.500 | 29.8 | 100.6 | 30009 | 0.734 | 2.046 | 18.744 | 19.025 | 25.536 | 1.649 | 1.296 | 1.918 |
| | 12.040 | 5.298 | 44 | 300 ppm PA | 0.000 | 50.9 | 98.2 | 35933 | 1.589 | 2.916 | 18.249 | 18.677 | 11.481 | 1.446 | 1.136 | 0.000 |
| | 12.040 | 5.298 | 44 | 300 ppm PA | 2.000 | 39.7 | 99.1 | 33562 | 1.149 | 2.390 | 17.986 | 18.323 | 15.651 | 1.446 | 1.136 | 0.884 |
| | 12.040 | 5.298 | 44 | 300 ppm PA | 4.600 | 36.6 | 99.2 | 33387 | 1.008 | 2.257 | 18.688 | 18.946 | 18.531 | 1.446 | 1.136 | 2.167 |
| | 12.040 | 5.298 | 44 | 300 ppm PA | 3.300 | 35.0 | 97.7 | 37201 | 0.947 | 2.193 | 20.484 | 20.772 | 21.634 | 1.446 | 1.136 | 1.602 |

TABLE 5-continued

Listing of Emulsion Flow Tests with three Chemical Additives

| Data Series | Total Liq. Rate gpm | Water Rate gpm | water-cut % | Chemical added | Gas Rate scf/min | Inlet Pres. psig | Avg. Temp. F. | Avg. Visc. cp | Hor. DP/DZ psi/ft | Vert. DP/DZ psi/ft | Pred. DP/DZ Horiz. psi/ft | Pred. DP/DZ Vertical psi/ft | Friction DP Ratio | VSO ft/s | VSW ft/s | VSG ft/s |
|---|---|---|---|---|---|---|---|---|---|---|---|---|---|---|---|---|
| | 11.070 | 4.871 | 44 | 300 ppm PA | 0.000 | 45.5 | 96.3 | 41388 | 1.474 | 2.554 | 19.326 | 19.754 | 13.109 | 1.330 | 1.045 | 0.000 |
| | 11.070 | 4.871 | 44 | 300 ppm PA | 2.000 | 38.2 | 99.6 | 32190 | 1.242 | 2.078 | 15.988 | 16.318 | 12.870 | 1.330 | 1.045 | 0.905 |
| | 11.070 | 4.871 | 44 | 300 ppm PA | 4.500 | 35.8 | 100.3 | 30719 | 1.090 | 2.115 | 15.981 | 16.234 | 14.658 | 1.330 | 1.045 | 2.146 |
| | 11.070 | 4.871 | 44 | 300 ppm PA | 3.300 | 34.3 | 100.5 | 30217 | 1.031 | 2.096 | 15.463 | 15.743 | 14.993 | 1.330 | 1.045 | 1.626 |
| | 8.590 | 3.780 | 44 | 300 ppm PA | 0.000 | 34.4 | 97.2 | 38797 | 1.123 | 1.940 | 14.058 | 14.485 | 12.519 | 1.032 | 0.811 | 0.000 |
| | 8.590 | 3.780 | 44 | 300 ppm PA | 2.000 | 31.6 | 98.5 | 35180 | 1.087 | 1.727 | 14.040 | 14.343 | 12.913 | 1.032 | 0.811 | 1.032 |
| | 8.590 | 3.780 | 44 | 300 ppm PA | 4.600 | 28.9 | 98.9 | 33909 | 1.060 | 1.461 | 14.449 | 14.665 | 13.627 | 1.032 | 0.811 | 2.522 |
| | 8.590 | 3.780 | 44 | 300 ppm PA | 3.300 | 29.0 | 98.9 | 34030 | 1.022 | 1.555 | 14.131 | 14.381 | 13.823 | 1.032 | 0.811 | 1.808 |
| | 6.431 | 2.830 | 44 | 300 ppm PA | 0.000 | 26.2 | 96.7 | 40297 | 0.829 | 1.494 | 10.931 | 11.359 | 13.182 | 0.773 | 0.607 | 0.000 |
| | 6.431 | 2.830 | 44 | 300 ppm PA | 2.000 | 24.2 | 98.4 | 35354 | 0.886 | 1.203 | 11.234 | 11.501 | 12.678 | 0.773 | 0.607 | 1.231 |
| | 6.431 | 2.830 | 44 | 300 ppm PA | 4.800 | 25.5 | 98.7 | 34630 | 0.891 | 1.378 | 11.942 | 12.123 | 13.406 | 0.773 | 0.607 | 2.862 |
| | 6.431 | 2.830 | 44 | 300 ppm PA | 3.400 | 26.2 | 98.0 | 36278 | 0.974 | 1.342 | 12.068 | 12.286 | 12.395 | 0.773 | 0.607 | 1.982 |
| | 4.170 | 1.835 | 44 | 300 ppm PA | 0.000 | 22.1 | 96.3 | 41628 | 0.622 | 1.363 | 7.322 | 7.7499 | 11.773 | 0.501 | 0.394 | 0.000 |
| | 4.170 | 1.835 | 44 | 300 ppm PA | 2.000 | 20.2 | 95.8 | 43109 | 0.779 | 1.042 | 10.035 | 10.261 | 12.880 | 0.501 | 0.394 | 1.367 |
| | 4.170 | 1.835 | 44 | 300 ppm PA | 5.300 | 22.0 | 95.6 | 43795 | 0.824 | 1.150 | 11.489 | 11.626 | 13.940 | 0.501 | 0.394 | 3.440 |
| | 4.170 | 1.835 | 44 | 300 ppm PA | 3.700 | 21.9 | 93.8 | 50926 | 0.894 | 1.070 | 12.770 | 12.94 | 14.289 | 0.501 | 0.394 | 2.393 |
| | 2.270 | 0.999 | 44 | 300 ppm PA | 0.000 | 15.9 | 95.9 | 42760 | 0.285 | 1.154 | 4.094 | 4.5222 | 14.346 | 0.273 | 0.214 | 0.000 |
| | 2.270 | 0.999 | 44 | 300 ppm PA | 2.000 | 18.9 | 95.9 | 42733 | 0.798 | 0.892 | 6.929 | 7.1178 | 8.683 | 0.273 | 0.214 | 1.417 |
| | 2.270 | 0.999 | 44 | 300 ppm PA | 5.500 | 18.5 | 94.8 | 46740 | 0.761 | 0.844 | 9.011 | 9.1119 | 11.849 | 0.273 | 0.214 | 3.941 |
| | 2.270 | 0.999 | 44 | 300 ppm PA | 3.700 | 20.9 | 93.7 | 51055 | 0.863 | 0.944 | 9.144 | 9.2813 | 10.599 | 0.273 | 0.214 | 2.460 |
| 0813C | 6.431 | 3.216 | 50 | 500 ppm FF | 0.000 | 6.2 | 88.8 | 113878 | 0.069 | 0.470 | 27.581 | 28.01 | 400.507 | 0.690 | 0.690 | 0.000 |
| | 7.150 | 3.575 | 50 | 500 ppm FF | 0.000 | 10.1 | 88.3 | 117471 | 0.257 | 0.599 | 31.632 | 32.061 | 123.096 | 0.767 | 0.767 | 0.000 |
| | 7.870 | 3.935 | 50 | 500 ppm FF | 0.000 | 6.8 | 85.3 | 140280 | 0.096 | 0.501 | 41.578 | 42.007 | 434.571 | 0.844 | 0.844 | 0.000 |
| | 8.590 | 4.295 | 50 | 500 ppm FF | 0.000 | 6.8 | 85.4 | 139339 | 0.088 | 0.510 | 45.077 | 45.506 | 513.183 | 0.921 | 0.921 | 0.000 |
| | 9.210 | 4.605 | 50 | 500 ppm FF | 0.000 | 7.2 | 88.2 | 118279 | 0.110 | 0.525 | 41.026 | 41.455 | 373.089 | 0.988 | 0.988 | 0.000 |
| | 9.830 | 4.915 | 50 | 500 ppm FF | 0.000 | 7.7 | 88.7 | 114490 | 0.143 | 0.532 | 42.385 | 42.814 | 295.733 | 1.054 | 1.054 | 0.000 |
| | 10.450 | 5.225 | 50 | 500 ppm FF | 0.000 | 8.0 | 84.9 | 142979 | 0.153 | 0.558 | 56.271 | 56.699 | 367.428 | 1.121 | 1.121 | 0.000 |
| | 11.070 | 5.535 | 50 | 500 ppm FF | 0.000 | 8.7 | 90.4 | 103782 | 0.200 | 0.568 | 43.268 | 43.696 | 216.670 | 1.187 | 1.187 | 0.000 |
| | 11.555 | 5.778 | 50 | 500 ppm FF | 0.000 | 9.3 | 87.8 | 121085 | 0.247 | 0.583 | 52.693 | 53.122 | 212.911 | 1.239 | 1.239 | 0.000 |
| | 12.040 | 6.020 | 50 | 500 ppm FF | 0.000 | 10.0 | 85.2 | 140952 | 0.272 | 0.616 | 63.913 | 64.342 | 234.609 | 1.291 | 1.291 | 0.000 |
| | 12.885 | 6.443 | 50 | 500 ppm FF | 0.000 | 11.2 | 87.4 | 124118 | 0.352 | 0.652 | 60.23 | 60.658 | 171.343 | 1.382 | 1.382 | 0.000 |
| 0901A | 2.270 | 0.795 | 35 | 20 ppm HC | 0.000 | 10.5 | 101.4 | 28274 | 0.264 | 0.640 | 3.1423 | 3.569 | 11.888 | 0.317 | 0.170 | 0.000 |
| | 4.170 | 1.460 | 35 | 20 ppm HC | 0.000 | 22.8 | 104.6 | 22801 | 0.847 | 1.106 | 4.6551 | 5.082 | 5.496 | 0.581 | 0.313 | 0.000 |
| | 6.431 | 2.251 | 35 | 20 ppm HC | 0.000 | 26.8 | 103.9 | 23874 | 1.017 | 1.271 | 7.5172 | 7.944 | 7.394 | 0.897 | 0.483 | 0.000 |
| | 8.590 | 3.007 | 35 | 20 ppm HC | 0.000 | 30.8 | 104.8 | 22443 | 1.209 | 1.390 | 9.4388 | 9.866 | 7.806 | 1.198 | 0.645 | 0.000 |
| | 10.450 | 3.658 | 35 | 20 ppm HC | 0.000 | 34.8 | 107.2 | 19188 | 1.431 | 1.486 | 9.8173 | 10.244 | 6.861 | 1.457 | 0.785 | 0.000 |
| | 12.040 | 4.214 | 35 | 20 ppm HC | 0.000 | 35.5 | 104.4 | 23096 | 1.468 | 1.478 | 13.615 | 14.042 | 9.272 | 1.679 | 0.904 | 0.000 |
| | 16.400 | 5.740 | 35 | 20 ppm HC | 0.000 | 34.2 | 108.0 | 18332 | 1.070 | 1.872 | 14.72 | 15.147 | 13.754 | 2.287 | 1.231 | 0.000 |
| 1019A | 2.270 | 0.908 | 40 | 20 ppm HC | 0.000 | 7.2 | 88.8 | 60872 | 0.054 | 0.524 | 6.2448 | 6.6723 | 116.675 | 0.292 | 0.195 | 0.000 |
| | 4.170 | 1.668 | 40 | 20 ppm HC | 0.000 | 6.7 | 87.5 | 66878 | 0.040 | 0.492 | 12.604 | 13.031 | 311.981 | 0.537 | 0.358 | 0.000 |
| | 6.431 | 2.572 | 40 | 20 ppm HC | 0.000 | 8.9 | 88.5 | 62038 | 0.207 | 0.511 | 18.031 | 18.458 | 87.202 | 0.828 | 0.552 | 0.000 |
| | 8.590 | 3.436 | 40 | 20 ppm HC | 0.000 | 18.4 | 90.1 | 55269 | 0.751 | 0.720 | 21.456 | 21.884 | 28.579 | 1.106 | 0.737 | 0.000 |
| | 11.070 | 4.428 | 40 | 20 ppm HC | 0.000 | 26.1 | 88.6 | 61870 | 0.843 | 1.292 | 30.953 | 31.381 | 36.722 | 1.425 | 0.950 | 0.000 |
| | 12.040 | 4.816 | 40 | 20 ppm HC | 0.000 | 27.5 | 92.4 | 47110 | 0.878 | 1.392 | 25.634 | 26.062 | 29.192 | 1.550 | 1.033 | 0.000 |
| | 13.730 | 5.492 | 40 | 20 ppm HC | 0.000 | 31.3 | 90.5 | 53670 | 1.030 | 1.563 | 33.303 | 33.73 | 32.336 | 1.767 | 1.178 | 0.000 |
| | 16.400 | 6.560 | 40 | 20 ppm HC | 0.000 | 24.7 | 92.6 | 46525 | 0.849 | 1.166 | 34.483 | 34.91 | 40.593 | 2.111 | 1.407 | 0.000 |

These include conditions with different operating temperature thus covering a very wide range of original emulsion viscosities.

Figure 18:
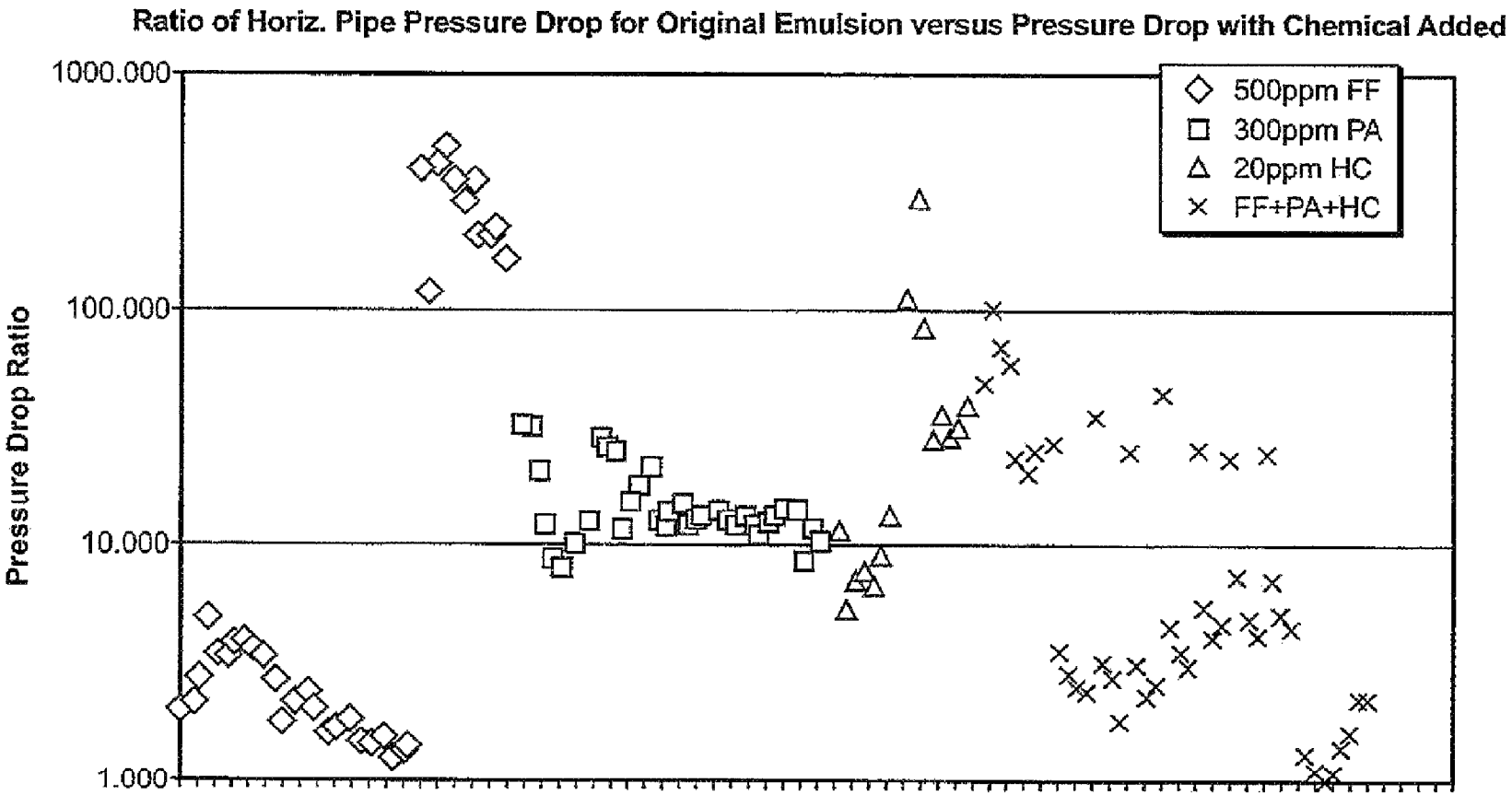
FIG. 18 shows a graph displaying a ratio of pressure drop for the horizontal pipe section over the predicted pressure drop with the original emulsion in accordance with an embodiment of the present disclosure.

The data of Table 4 have been used to interpolate and derive the average viscosity value for each flow condition listed in Table 5. For comparison purposes, Table 5 includes predictions of the pressure gradient for both the horizontal and the vertical pipe sections for the original emulsion with the appropriate effective viscosity derived from interpolation of Table 4. In all tests conducted lower frictional pressure drops were derived as a result of the addition of each chemical than predicted for the original emulsion. FIG. 18 displays the ratio of the pressure drop for the horizontal pipe section over the predicted pressure drop with the original emulsion. For all tests this ratio is higher than one and as high as 513. The pressure drop results derived with either the FF chemical or with the combination of all three chemical additives (FF+PA+HC) showed equally small and exceptional improvement over the original emulsion as shown in FIG. 18. For this reason we considered that the PA and HC chemicals were the most promising. Experimentation with small sample volumes of tight water in oil emulsions and the PA and HC chemicals at 300 and 20 ppm concentrations respectively revealed that both of these chemicals cause free water to appear at the bottom of the sample containers. It is speculated that during flow, this generated free water migrates to the pipe wall and provides for a lubricating effect much like in the coreflow phenomenon. Since either of these two chemicals causes water separation from the emulsion, their addition to a coreflow stream is also recommended to facilitate the separation of water.

The invention claimed is:

1. A system adapted to transport two fluids and a gas, comprising:

a nozzle comprising:

a first nozzle portion comprising the first fluid and the gas, wherein the first fluid and the gas comprise from about 1% to about 25% by volume of the gas and the nozzle includes an inner surface tapered at an angle; and a second nozzle portion comprising the second fluid, wherein the second nozzle portion has a larger diameter than and is about the first nozzle portion; and a tubular fluidly connected to and downstream of the nozzle, the tubular comprising the first fluid and the gas in a core, and the second fluid about the core.

2. The system of claim 1, wherein the first fluid comprises a higher viscosity than the second fluid.

3. The system of claim 1, further comprising a pump upstream of the nozzle, wherein the pump has a first outlet to the large diameter nozzle portion and a second outlet to the small diameter nozzle portion.

4. The system of claim 1, further comprising a pump downstream of the nozzle, wherein the pump is adapted to receive a core flow from the nozzle into a pump inlet.

5. The system of claim 1, wherein the first fluid comprises a viscosity from 30 to 2,000,000, centipoise, at the temperature and pressure the first fluid flows out of the nozzle.

6. The system of claim 1, wherein the second fluid comprises a viscosity from 0.001 to 50 centipoise, at the temperature and pressure the second fluid flows out of the nozzle.

7. The system of claim 1, wherein the second fluid comprises a silicate and an emulsion breaker.

8. The system of claim 1, wherein the second fluid comprises from 5% to 40% by volume, and the first fluid and the gas comprises from 60% to 95% by volume of the total volume of the second fluid, the first fluid, and the gas as the second fluid, the first fluid, and the gas leave the nozzle.

9. The system of claim 1, wherein the gas comprises one or more of methane, ethane, propane, butane, carbon dioxide, and mixtures thereof.

10. The system of claim 1, wherein the tubular has at least one vertical portion.

11. A method for transporting a first fluid, a second fluid, and a gas, comprising:

injecting the first fluid and the gas through a first nozzle portion into a core portion of a tubular, wherein the first fluid and the gas comprise from about 1% to about 25% by volume of the gas and the nozzle includes an inner surface tapered at an angle;

injecting the second fluid through a second nozzle portion into the tubular, the second fluid injected about the core portion of the first fluid and the gas.

* * * * *